US009315304B2

(12) United States Patent
Spiegelhoff et al.

(10) Patent No.: US 9,315,304 B2
(45) Date of Patent: Apr. 19, 2016

(54) CLOSURE WITH SLIDING SEAL MEMBER

(75) Inventors: Timothy Spiegelhoff, Burlington, WI (US); Timothy M. Mazurkiewicz, Milwaukee, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 14/373,281

(22) PCT Filed: Mar. 29, 2012

(86) PCT No.: PCT/US2012/031204

§ 371 (c)(1),
(2), (4) Date: Jul. 18, 2014

(87) PCT Pub. No.: WO2013/147792

PCT Pub. Date: Oct. 3, 2013

(65) Prior Publication Data

US 2014/0367385 A1 Dec. 18, 2014

(51) Int. Cl.
*B65D 47/28* (2006.01)
*B65D 75/58* (2006.01)
(Continued)

(52) U.S. Cl.
CPC ..... *B65D 47/286* (2013.01); *B65D 43/20* (2013.01); *B65D 51/242* (2013.01); *B65D 75/5883* (2013.01); *B65D 2575/586* (2013.01)

(58) Field of Classification Search
CPC .. B65D 43/20; B65D 47/286; B65D 75/5883; B65D 51/242; B65D 2575/586
USPC ..... 220/345.4, 254.1, 254.3, 359.1, 811, 220/812, 813, 815
See application file for complete search history.

(56) References Cited

U.S. PATENT DOCUMENTS 2,272,867 A * 2/1942 Cobel ..... 222/473
4,989,746 A * 2/1991 Pierce ..... 220/254.3
(Continued)

FOREIGN PATENT DOCUMENTS

CA 2793036 A1 9/2011
CN 201990040 U 9/2011
(Continued)

OTHER PUBLICATIONS

The "International Search Report and Written Opinion of the International Searching Authority, or the Declaration" dated Aug. 13, 2012 for the International Application No. PCT/US2012/031204 of which the above-captioned instant U.S. patent application Serial No. (not yet designated) is a U.S. national phase application.

*Primary Examiner* — Fenn Mathew
*Assistant Examiner* — Elizabeth Volz
(74) *Attorney, Agent, or Firm* — Wood, Phillips, Katz, Clark & Mortimer

(57) ABSTRACT

A closure is provided for a container that has an opening to the container interior wherein contents may be stored. The closure includes the following: (A) a body having at least one access aperture that can communicate with the container opening and that can accommodate removal of the contents in a discharge direction out of the at least one access aperture; (B) a sliding seal member disposed on the body for accommodating movement of the seal member relative to said at least one access aperture between (a) a closed position sealing against the closure body at the at least one access aperture to occlude the at least one access aperture, and (b) an open position exposing the at least one access aperture; and (c) cooperating guide surfaces on the body and the sliding seal member for guiding the sliding seal member.

13 Claims, 34 Drawing Sheets

(51) Int. Cl.
*B65D 51/24* (2006.01)
*B65D 43/20* (2006.01)

(56) References Cited

U.S. PATENT DOCUMENTS

| | | | | |
|---|---|---|---|---|
| 5,063,644 | A | 11/1991 | Herrington et al. | |
| 5,301,394 | A | 4/1994 | Richardson et al. | |
| 5,390,828 | A | 2/1995 | Gross | |
| 5,413,257 | A * | 5/1995 | Amberger et al. | 222/472 |
| 5,442,837 | A | 8/1995 | Morgan | |
| 5,462,189 | A * | 10/1995 | Pierce | 220/815 |
| 6,290,393 | B1 | 9/2001 | Tomic | |
| 6,347,885 | B1 | 2/2002 | Buchman | |
| 6,439,442 | B1 | 8/2002 | Markert et al. | |
| 6,474,866 | B2 | 11/2002 | Buchman | |
| 7,258,245 | B2 | 8/2007 | Bauer | |
| 2007/0151979 | A1 * | 7/2007 | Klump et al. | 220/912 |
| 2007/0170191 | A1 | 7/2007 | Arvidsson et al. | |
| 2011/0226772 | A1 * | 9/2011 | Adler et al. | B65D 50/046 220/315 |

FOREIGN PATENT DOCUMENTS

| | | | |
|---|---|---|---|
| CN | 102285483 | A | 12/2011 |
| GB | 2217695 | A | 11/1989 |

* cited by examiner

CLOSURE WITH SLIDING SEAL MEMBER

TECHNICAL FIELD

This invention relates to container closures.

BACKGROUND OF THE INVENTION AND TECHNICAL PROBLEMS POSED BY THE PRIOR ART

Various substances (including lotions, creams, food items, granules, liquids, powders, small articles, etc.) may be packaged in a rigid, flexible, or collapsible container (e.g., bottle, pouch, etc.) having a closure that can be opened and closed. The container with the closure mounted thereon and the contents stored therein may be characterized as a "package."

The inventors of the present invention have invented a novel structure for a container closure wherein the closure includes advantageous features not heretofore taught or contemplated by the prior art.

SUMMARY OF THE INVENTION

According to broad aspects of one form of the invention, a closure is provided for a container that has an opening to the container interior wherein contents may be stored. The closure includes a body that is either (a) a separate structure for being attached to the container at the opening, or (b) a structure formed as a unitary portion of the container at the opening. The body has at least one access aperture that can communicate with the container opening and that can accommodate removal of the contents in a discharge direction out of the at least one access aperture.

The closure also includes a sliding seal member that is disposed on the body for accommodating movement of the seal member relative to the at least one access aperture between (a) a closed position sealing against the closure body at the at least one access aperture to occlude the at least one access aperture, and (b) an open position exposing the at least one access aperture.

The closure also includes cooperating guide surfaces on the body and sliding seal member for guiding at least part of the sliding seal member at least in the discharge direction away from the at least one access aperture and for guiding the sliding seal member at least in a lateral direction away from the at least one access aperture to the open position.

The closure can be provided with a design that accommodates efficient, high quality, large volume manufacturing techniques with a reduced product reject rate.

The closure can optionally be designed to accommodate its use with a variety of conventional or special containers having a variety of conventional or special container finishes (e.g., snap-fit attachment configurations, thermal bonding configurations. etc.).

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
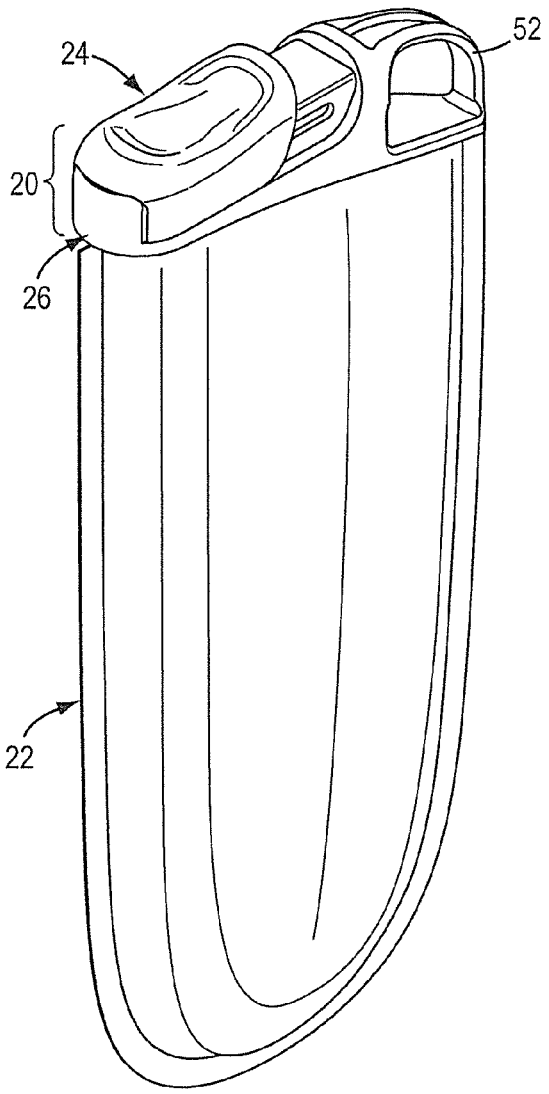
FIG. 1 is an isometric view of a first embodiment of a closure of the present invention wherein the closure is shown installed on flexible pouch type of container with the closure in the closed condition and wherein the closed closure, container, and contents therein together define a package.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, many of the figures illustrating the invention show the embodiments of the closure of this invention in the typical orientation that the closure would have at the top of a container when the container is oriented upright, and terms such as upper, lower, horizontal, etc., are used with reference to this orientation. It will be understood, however, that the closure of this invention may be manufactured, stored, transported, used, and sold in an orientation other than the orientations described.

The closure of this invention is suitable for use with a variety of conventional or special containers, the details of which, although not fully illustrated or described, would be apparent to those having skill in the art and an understanding of such containers. The particular containers, per se, that are illustrated and described herein form no part of and therefore are not intended to limit, the present invention. It will also be understood by those of ordinary skill that novel and non-obvious inventive aspects are embodied in the described exemplary closures alone.

The closure will typically be used on a container that contains a product (e.g., a lotion) in the form of a material or substance that can be dispensed, or otherwise removed, from the container through the opened closure. The product may be, for example, a fluent material such as a liquid, cream, powder, slurry, or paste. If the container and closure are large enough, then the product could also be discrete pieces of material (e.g., food products such as nuts, candies, crackers, cookies, etc. or non-food products including various particles, granules, etc.) which can be removed through an open closure by hand from a container, or scooped out of a container, or ladled out of a container, or poured out of a container. Such materials may be sold, for example, as a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

A first embodiment of a closure of the present invention is illustrated in the Figures wherein the closure is designated generally by reference number 20. In the illustrated first embodiment, the closure 20 is provided in the form of a separate closure 20 which may consist of an assembly of multiple pieces and which is adapted to become attached to a container 22 (FIG. 1) that would typically contain contents such as a product or products consisting of articles or fluent material.

Figure 2:
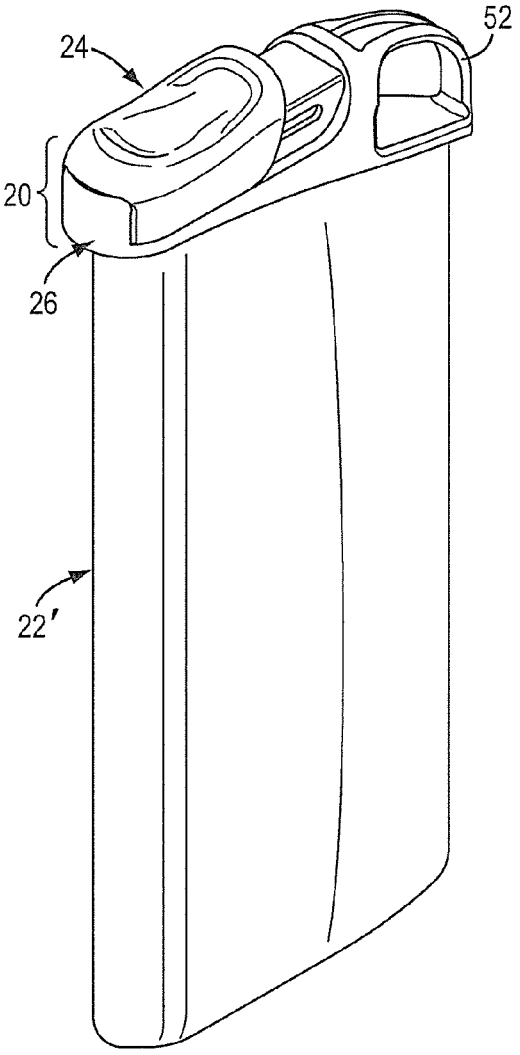
FIG. 2 is an isometric view of the same closure shown in FIG. 1, but in FIG. 2 the closure is shown installed on a semi-rigid, resilient wall container with the closure in the closed condition and wherein the closed closure, container, and contents therein together define a package.

The container 22 shown in FIG. 1 is a collapsible, flexible pouch. FIG. 2 shows the closure 20 on a generally rigid container 22' (which may have somewhat flexible, resilient walls).

The container 22 or 22' typically has a top portion extending upwardly to define an opening to the container interior (not visible in FIGS. 1 and 2). The container 22 or 22' may be formed from a material suitable for the intended application (e.g., a thin, flexible material for a pouch wherein such a material could be a polyethylene terephthalate (PET) film or a polyethylene film and/or an aluminum foil, or molded polyethylene or polypropylene for a more rigid container).

It is contemplated that typically, after the closure manufacturer makes the closure 20 (e.g., by molding the closure 20 from a thermoplastic polymer), the closure manufacturer will then ship the closure 20 to a container filler facility at another location where the container 22 or 22' is either manufactured or otherwise provided, and where the container 22 or 22' is filled with a product. If the container is a collapsible pouch, the closure 20 can be attached to the pouch as the pouch is being made and filled, or as the pouch is being made but before the pouch is subsequently filled through the open closure or through open regions of the pouch walls that are later sealed closed.

In the illustrated embodiments, the closure is provided as a separately manufactured article, component, or unit for being non-removably attached (e.g., mounted or installed) on a container. It will be appreciated, however, that in some applications (not illustrated), it may be desirable for the closure 20 to be attached to a container in a manner that would allow the user to remove the closure 20 from the container. Further, it may be desirable for the closure (or at least a base portion of the closure) to be formed as a unitary part, or extension, of the container wherein such a unitary part or extension also (i.e., simultaneously) defines an end structure of the container, per se.

The illustrated closures, if initially formed separately from the container, are adapted to be attached to a container at an opening which provides access to the container interior and to the contents (e.g., a product contained therein) after a portion of the closure is opened as described hereinafter.

The container (e.g., the illustrated container 22 or 22'), per se, does not form a part of the broadest aspects of the present invention, per se. The container may have any suitable configuration. The container typically includes an upper end portion or other suitable structure on some part of the container that defines the container mouth or opening (e.g., a mouth or opening that is not visible in the container 22 or 22'), and such a container opening has a cross-sectional configuration with which the closure is adapted to engage. The main body portion of the container may have another cross-sectional configuration that differs from the cross-sectional configuration of the container at the container opening. On the other hand, the container may instead have a substantially uniform shape along its entire length or height without any portion of reduced size or different cross-section.

The container may be a flexible pouch or may be a rigid container having a generally rigid or flexible wall or walls which can be grasped by the user. Particular embodiments of the inventive closure illustrated in the Figures are especially suitable for use with a container that is a pouch with collapsible walls. However, the embodiments of the closure are also suitable for use with a bottle having a substantially flexible wall or walls that can be squeezed or deflected laterally inwardly by the user to increase the internal pressure within the container so as to force the product out of the container and through the opened closure. In a bottle with a flexible wall or walls, such a flexible wall or walls typically have sufficient, inherent resiliency so that when the squeezing forces are removed, the container walls return to the normal, unstressed shape.

In other applications it may be desirable to employ a generally rigid container, and to pressurize the container interior at selected times with a piston or other pressurizing system, or to reduce the exterior ambient pressure so as to suck the material out through the open closure.

On the other hand, if the closure has a suitably large access aperture that can be opened to communicate with the container interior, then such a closure can be used on a rigid container from which the contents (e.g., the product) can be accessed through the open closure and removed by pouring out the contents, or by scooping out the contents, or by withdrawing the contents by hand, etc.

In the illustrated first embodiment, the closure 20 includes a sliding seal member 24 and a closure body 26. The sliding seal member 24 may also be designated as a "slider" 24. The closure body 26 and the slider 24 are preferably each molded separately as a unitary structure from a suitable thermoplastic material such as polyethylene, polypropylene, or the like. Other materials may be employed instead.

In the illustrated first embodiment of the closure 20, the lower portion of the closure body 26 has a generally boat-like peripheral configuration which is open on the bottom. However, the closure body 26 may have other configurations. For example, the lower portion of the closure body 26 might have a prism or polygon configuration adapted to be mounted to the top of a container neck having a mating configuration.

After the closure body 24 and slider 26 are molded, the manufacturer installs the slider 26 on the closure body 24 in the closed position. The closed closure 20 would typically then be shipped to a pouch manufacturer or bottler which would provide a container (e.g., container 22 or 22' as shown in FIGS. 1 and 2), and the pouch manufacturer or bottler would install the closure 20 on the container 22 or 22'. The container may have already been filled with product, or the closure may be installed on an empty container which is subsequently filled with product through an open bottom end of the container which is thereafter sealed closed.

It is presently contemplated that most pouch manufacturers will prefer to install the closure 20 on the pouch type of container 22 with heat sealing techniques, and most bottlers would prefer to install the closure on a container 22' with the closure suitably configured for a snap-fit attachment or threaded attachment as explained below. In an alternative installation process, the closure 20 (with the body 24 as illustrated) could be installed on the container 22 or 22' with adhesive.

The closure body 26 could be modified with various configurations and attachment features (not shown) that might be particularly useful—especially for a container having semi-rigid, resilient walls, or having rigid walls. For example, the closure body 26 could have a round lower end with a thread for threadingly engaging a mating thread of a container. In another alternative (not illustrated), the closure and container could be provided with a suitable snap-fit engagement that would be intended to resist removal of the closure by a user of the package.

Further, other means of providing a generally non-removable or removable attachment of the closure to the container are contemplated. These other means could include the use of a suitable mechanical lock system, spin welding of the closure to the container, etc.

Figure 3:
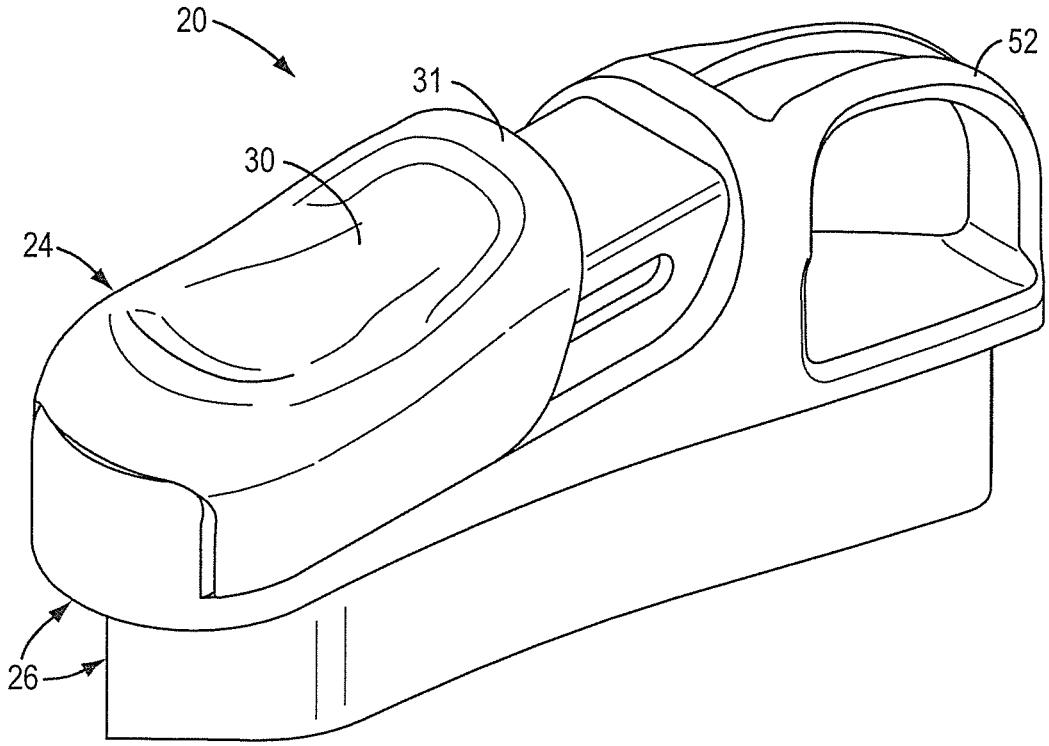
FIG. 3 is an isometric view of the first embodiment of the closure alone in the closed condition prior to installation on a container such as the container shown in FIG. 1 or the container shown in FIG. 2.
Figure 4:
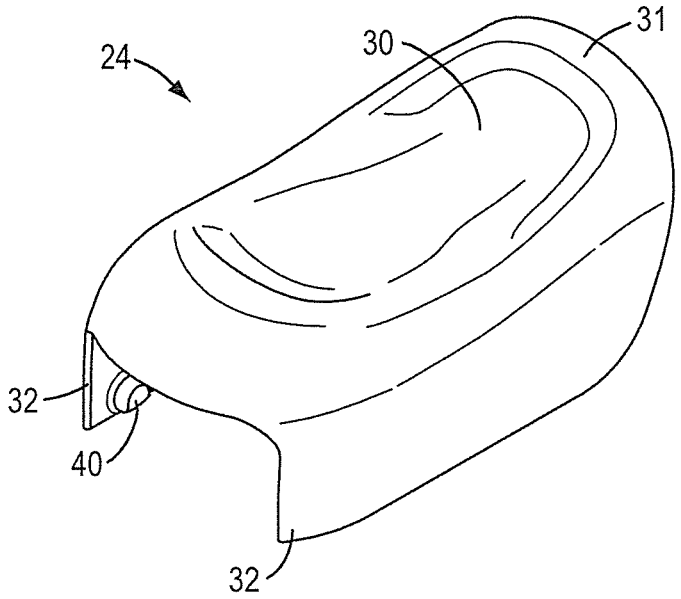
FIG. 4 is an isometric view from an upper front corner of the sliding seal member or "slider" of the closure shown in FIG. 3.
Figure 5:
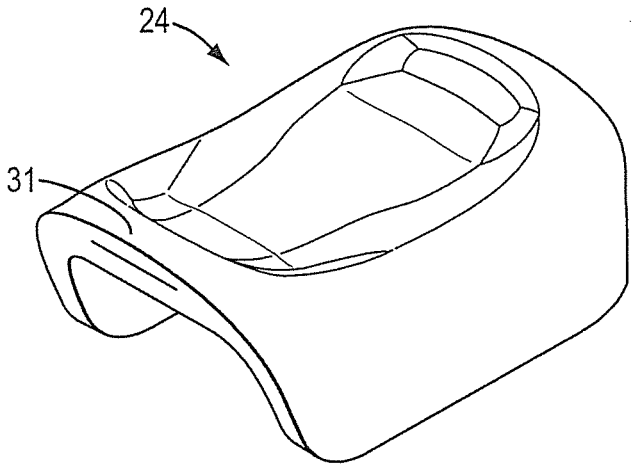
FIG. 5 is an isometric view from an upper rear corner of the slider shown in FIG. 4.

The slider 24, which is illustrated in the closed position on the closure body 26 in FIG. 3, is separately illustrated in FIGS. 4-7. As can be seen in FIG. 4, the slider 24 has an upwardly facing engageable platform 30 that includes a rear raised portion 31 which can be engaged by a user's thumb or finger to effect movement of the slider 24 along the top of the closure body 26.

Figure 6:
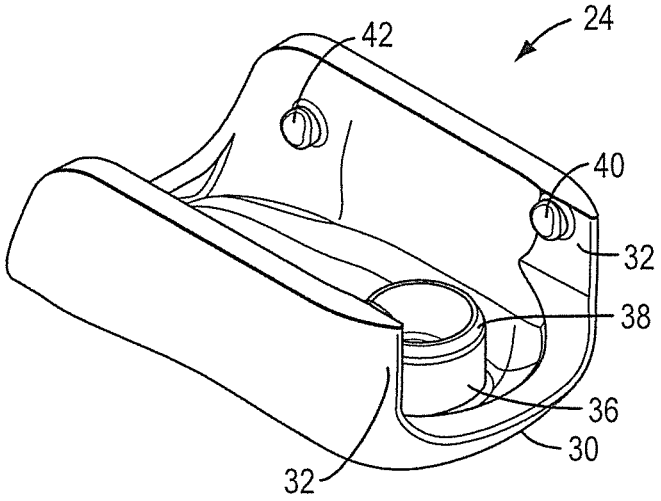
FIG. 6 is an isometric view of the underside of the slider shown in FIG. 4 as viewed from a front corner of the slider.

As can be seen in FIG. 4, depending from each side of the engageable platform 30 is a downwardly extending sidewall 32. As can be seen in FIG. 6, a generally cylindrical seal member in the fowl of a cylindrical plug 36 projects from the underside of the engageable platform 30 between the two spaced-apart walls 32. The cylindrical plug 36 has a frusto-conical, or tapered, distal end 38.

Figure 7:
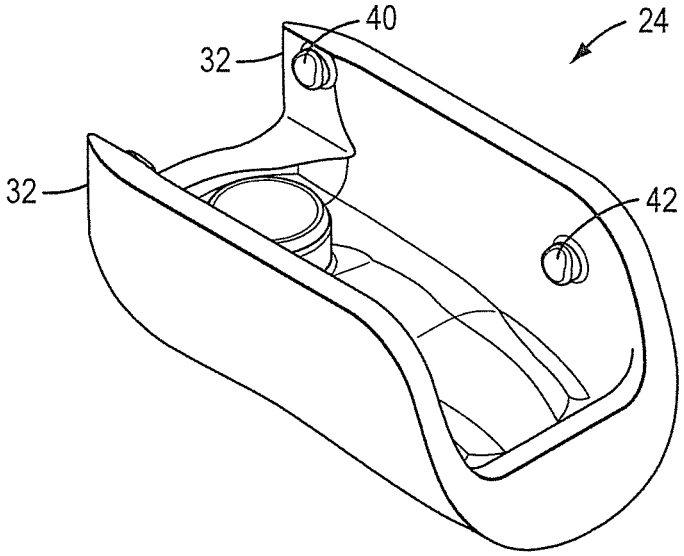
FIG. 7 is an isometric view of the underside of the slider shown in FIG. 4 as viewed from a rear corner of the slider.

As can be seen in FIGS. 6 and 7, pairs of cam follower pins—a pair of front pins 40 and a pair of rear pins 42—project inwardly from the inner surface of each sidewall 32. Each pin 40 and 42 may be characterized as part of cooperating guide surfaces on the body 26 and slider 24 as explained in detail hereinafter.

FIGS. 8-11 illustrate the closure body 26 which includes a lower peripheral wall 50 having a generally boat-shaped configuration with an open bottom end. The lower peripheral wall 50 is adapted to be engaged by, and attached to, the inside of the container (e.g., container 22 or 22'). Typically, the peripheral wall 50 would be non-removably attached to the container inside the opening at the top of the container by means of heat-sealing or with adhesive or the like.

An upper portion of the closure body 26 above the lower wall 50 includes a loop-type handle 52 (FIG. 8) at the rear end of the closure body 26. It will be appreciated that the closure handle 52 (FIG. 1) defines a loop or hook by which the package can be hung if desired.

The top of the closure body 26 defines a deck 56 forwardly of the handle 52. Toward the front end of the closure body 26, the deck 56 defines at least one access aperture 60 that extends through the thickness of the deck 56 for establishing communication between the interior of the closure body 26 and the exterior of the closure body 26. When the closure 20, comprising the assembly of the slider 24 and closure body 26, is properly installed on the container, the interior of the closure body 26 below the access aperture 60 is in communication with the interior of the container (e.g., container 22 or 22').

Figure 8:
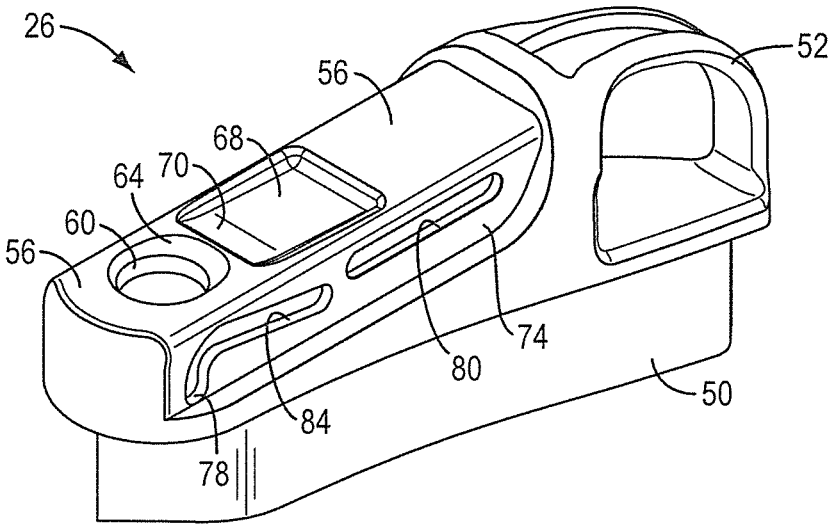
FIG. 8 is an isometric view from an upper front corner of the closure body of the closure shown in FIG. 3.

As can be seen in FIG. 8, deck 56 of the closure body 26 defines a chamfered surface 64 around the access aperture 60. Also, just rearwardly of the access aperture 60 and chamfered surface 64, the deck 56 defines a recess 68 which is spaced rearwardly from the access aperture 60. As can be seen in FIG. 8, the recess 68 has a front end defined by a sloping surface 70 which slopes from the top surface of the deck 56 adjacent outer periphery of the chamfered surface 64 downwardly into the bottom of the recess 68.

Figure 9:
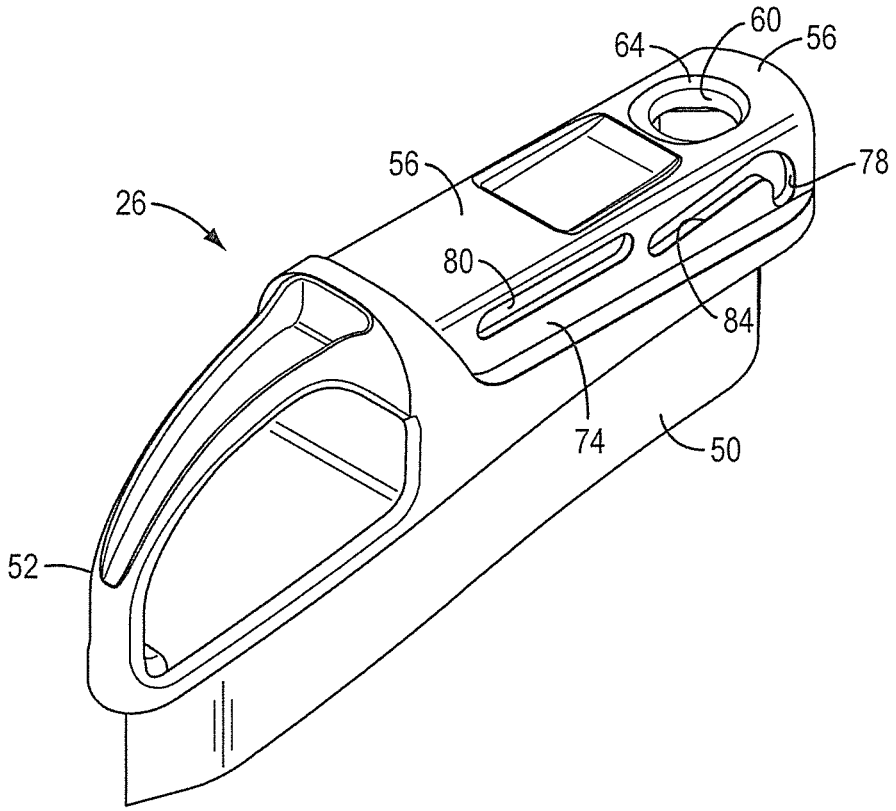
FIG. 9 is an isometric view from an upper rear corner of the closure body shown in FIG. 8.
Figure 10:
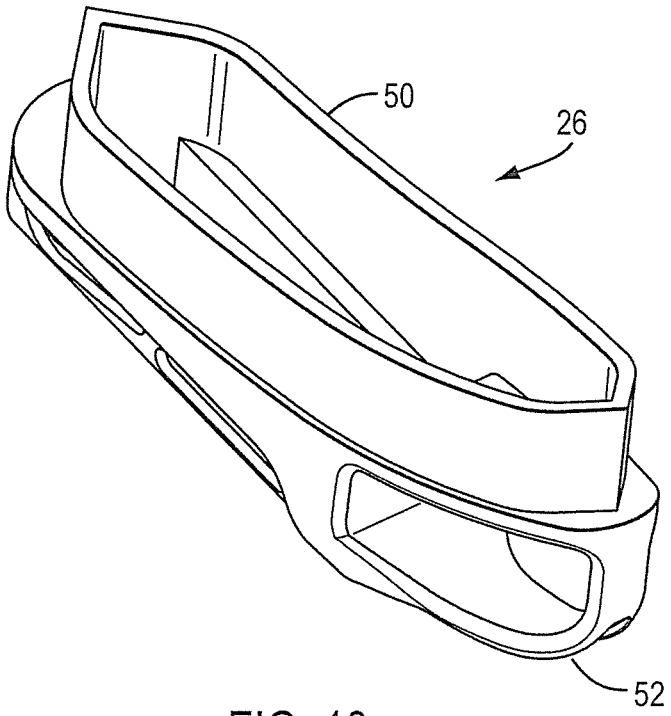
FIG. 10 is an isometric view of the underside of the closure body shown in FIG. 8 as viewed from a rear corner of the closure body.
Figure 11:
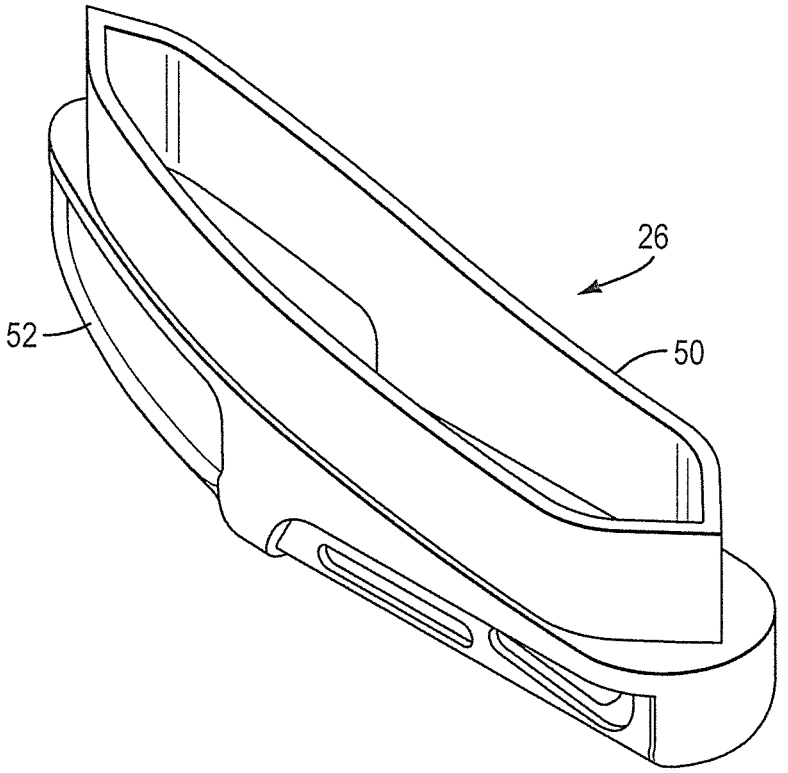
FIG. 11 is an isometric view of the underside of the closure body shown in FIG. 8 as viewed from a front corner of the closure body.
Figure 12:
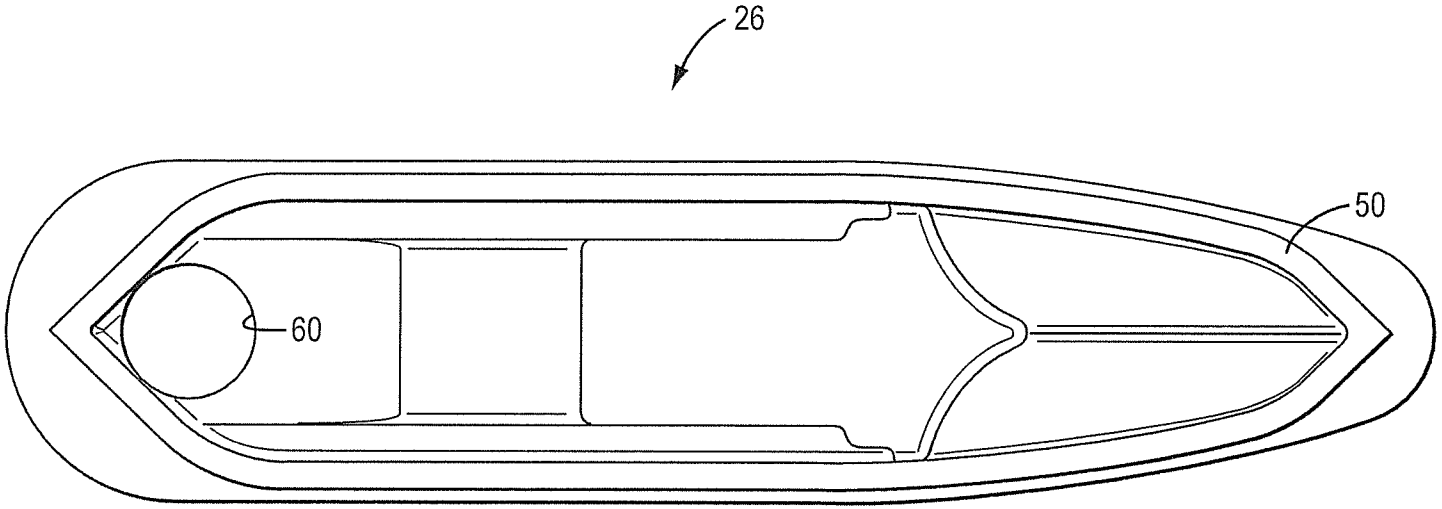
FIG. 12 is a bottom plan view of the closure body shown in FIG. 8.
Figure 13:
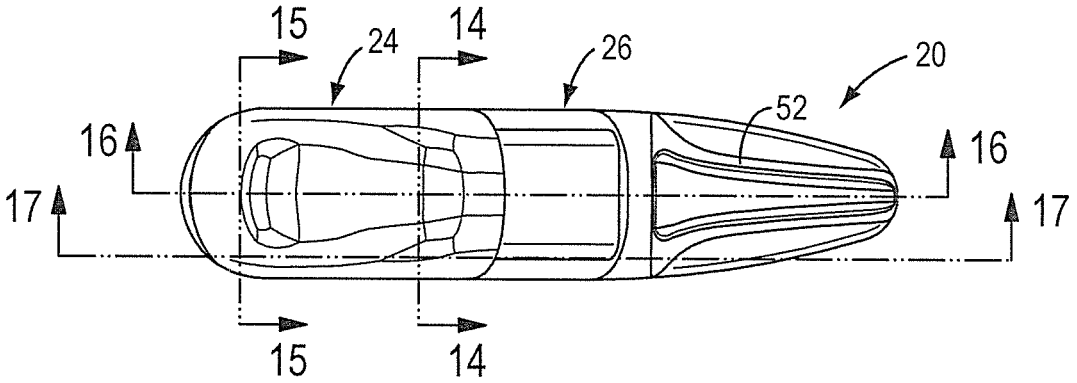
FIG. 13 is a top plan view of the closed closure shown in FIG. 3.
Figure 14:
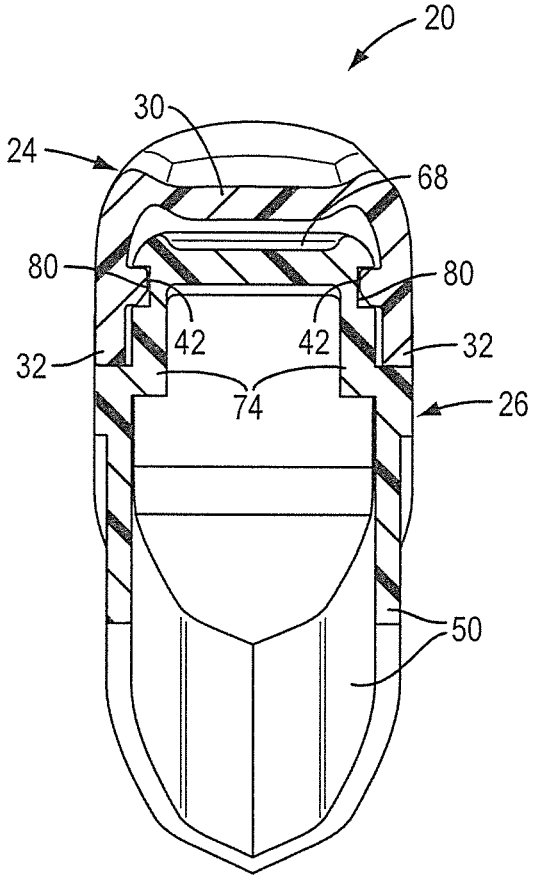
FIG. 14 is an enlarged, cross-sectional view taken generally along the plane 14-14 in FIG. 13.
Figure 15:
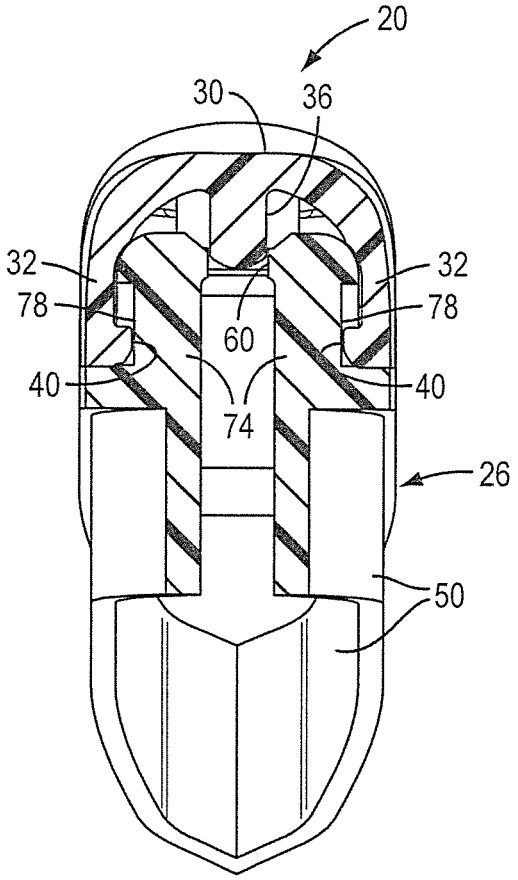
FIG. 15 is an enlarged, cross-sectional view taken generally along the plane 15-15 in FIG. 13.

As can be seen in FIGS. 8 and 9, the upper portion of the closure body 26 includes two outwardly facing sides 74. Each side 74 defines cooperating guide surfaces which, in the preferred embodiment illustrated in FIGS. 8 and 9, consist of (A) a front cam track portion in the form of a front cam groove 78, (B) a rear can track portion in the form of a rear cam groove 80, and (C) an intermediate cam track portion in the form of an intermediate cam groove 84.

Figure 24:
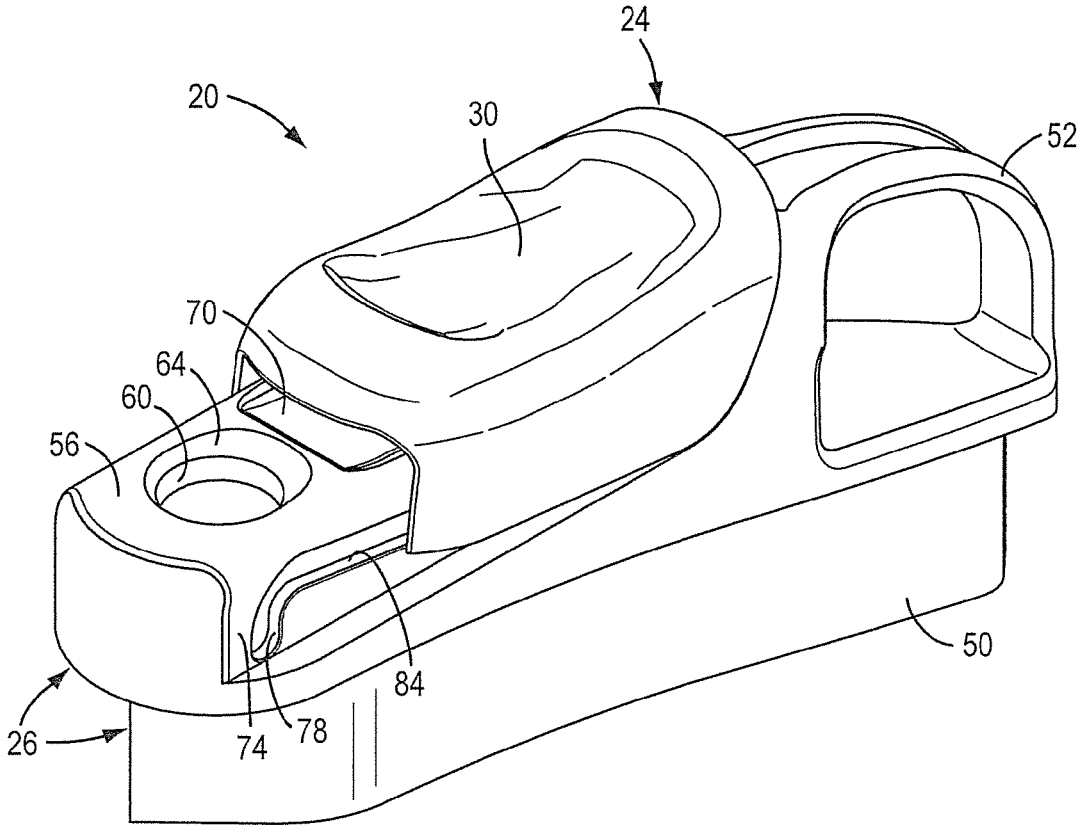
FIG. 24 is a view similar to FIG. 3, but FIG. 24 shows the closure in a fully opened condition.
Figure 25:
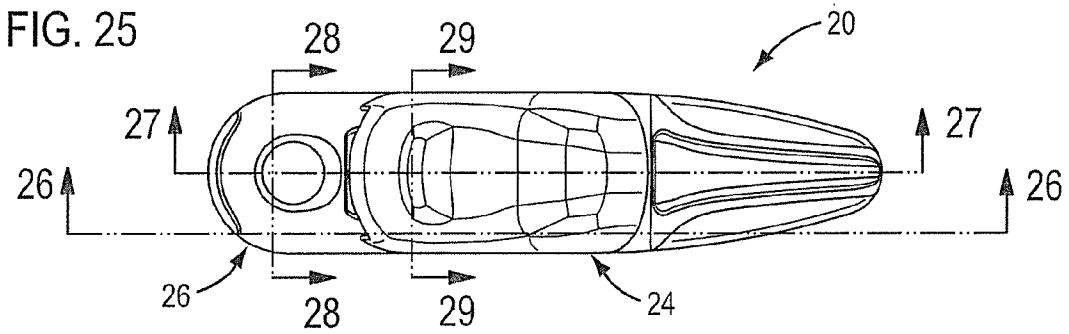
FIG. 25 is a top plan view of the fully opened closure shown in FIG. 24.
Figure 26:
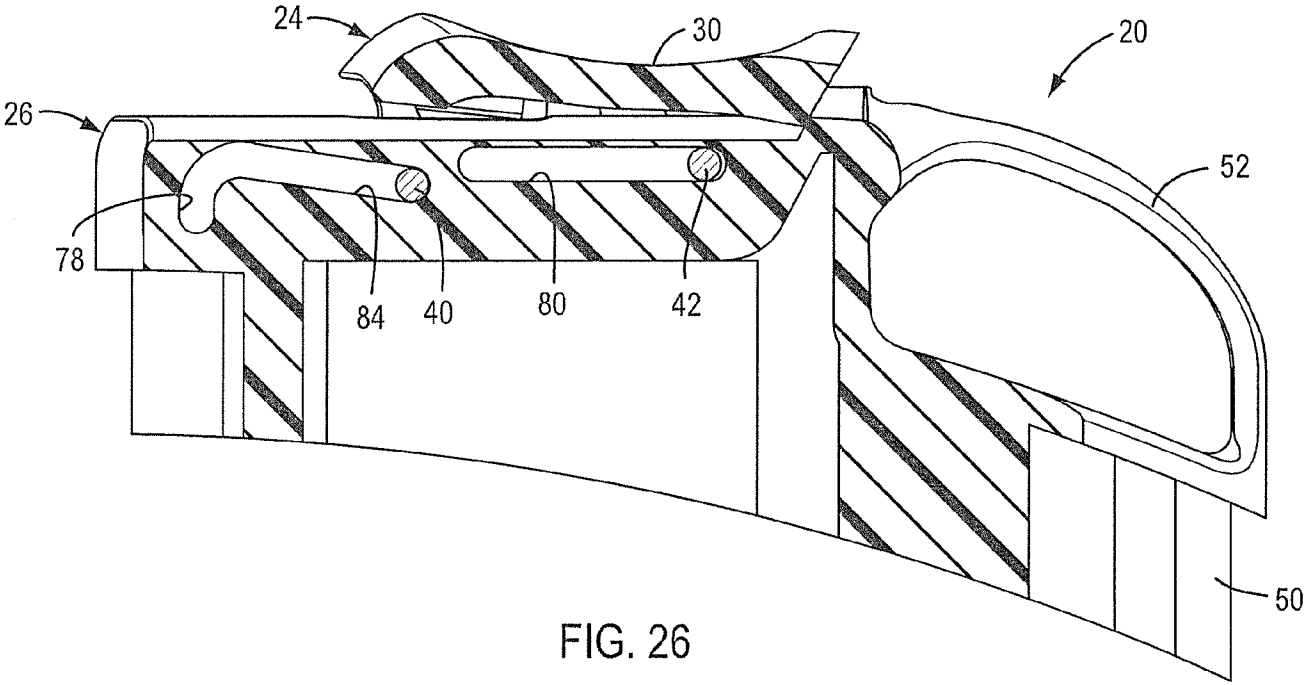
FIG. 26 is an enlarged, cross-sectional view taken generally along the plane 26-26 in FIG. 25.

The front cam track portion front cam groove 78 is oriented generally vertically relative to the height of the closure body 26. The front cam track portion front cam groove 78 may be described as extending in a discharge direction wherein the discharge direction is the direction from which contents can be removed through the access aperture 60 from the inside of the closure body 26 when the closure slider 24 is moved to the fully opened position (FIG. 24). (The contents may be removed from a container to which the closure 20 is mounted by a number of different removal methods depending upon the nature of the contents, the size of the access aperture 60, and other factors. For example, if the closure 20 is installed on a flexible, collapsible pouch type of container 22, then the container 22 and opened closure 20 could be tipped generally upside down, and the contents could be allowed flow out of the open access aperture 60 under the influence of gravity and/or with the assistance of the user squeezing on the container 22 to force the contents out of the collapsible container. On the other hand, if the container is relatively large, and if the closure 20 is relatively large and has a relatively large access aperture 60, then the contents could be withdrawn from the container through the open aperture 60 with a scoop, ladle, or by hand. In any event, passage of the contents from the container through the closure access aperture 60 defines a discharge direction.)

The discharge direction is generally in the direction out of and away from the access aperture 60. Thus, the front cam track portion front cam groove 78 may be characterized as extending in the discharge direction from the bottom, distal end of the front cam groove 78 upwardly or outwardly to the top of the front cam groove 78 where the front cam groove 78 merges with, or extends into, the forward end of the intermediate cam track portion intermediate cam groove 84.)

The intermediate cam track portion intermediate cam groove 84 is located laterally between the front cam track portion front cam groove 78 and the rear cam track portion rear cam groove 80. In the preferred first embodiment of the closure 20 illustrated in FIGS. 1-29, the rear cam groove 80 is separate from, and does not extend into, the intermediate cam groove 84.

The separate rear cam groove 80 is linear and is generally normal to the discharge direction of the contents through the access aperture 60. In the preferred embodiment illustrated in FIG. 8, wherein the access aperture 60 is a cylindrical aperture defining a generally vertical axis parallel to the height of the closure 20 and to the height of the container (e.g., container 22 in FIG. 1), the linear rear cam groove 80 is generally normal to the axis of the access aperture 60.

It will be noted that the intermediate cam track portion intermediate cam groove 84 extends laterally from the top of front cam grove 78 and toward the rear cam groove 80. The linear intermediate cam groove 84 is oriented at an acute angle relative to the rear cam groove 80. More specifically, the linear intermediate cam groove 84 is oriented to slope away from the access aperture 60 within increasing distance rearwardly from the access aperture 60.

The bottom of the boat-shaped sidewall 50 of the closure body 26 is open, and when the closure 20 is installed on a container, the closure body bottom opening communicates with the container interior. The large opening across the bottom of the closure body 26 readily accommodates the flow of product from the container into the closure body 26 for discharge through the access aperture 60 when the closure 20 is in the open condition. This configuration provides the user of the package with the capability for discharging substantially all of the product out of the package and can provide positive feedback to the user.

Figure 16:
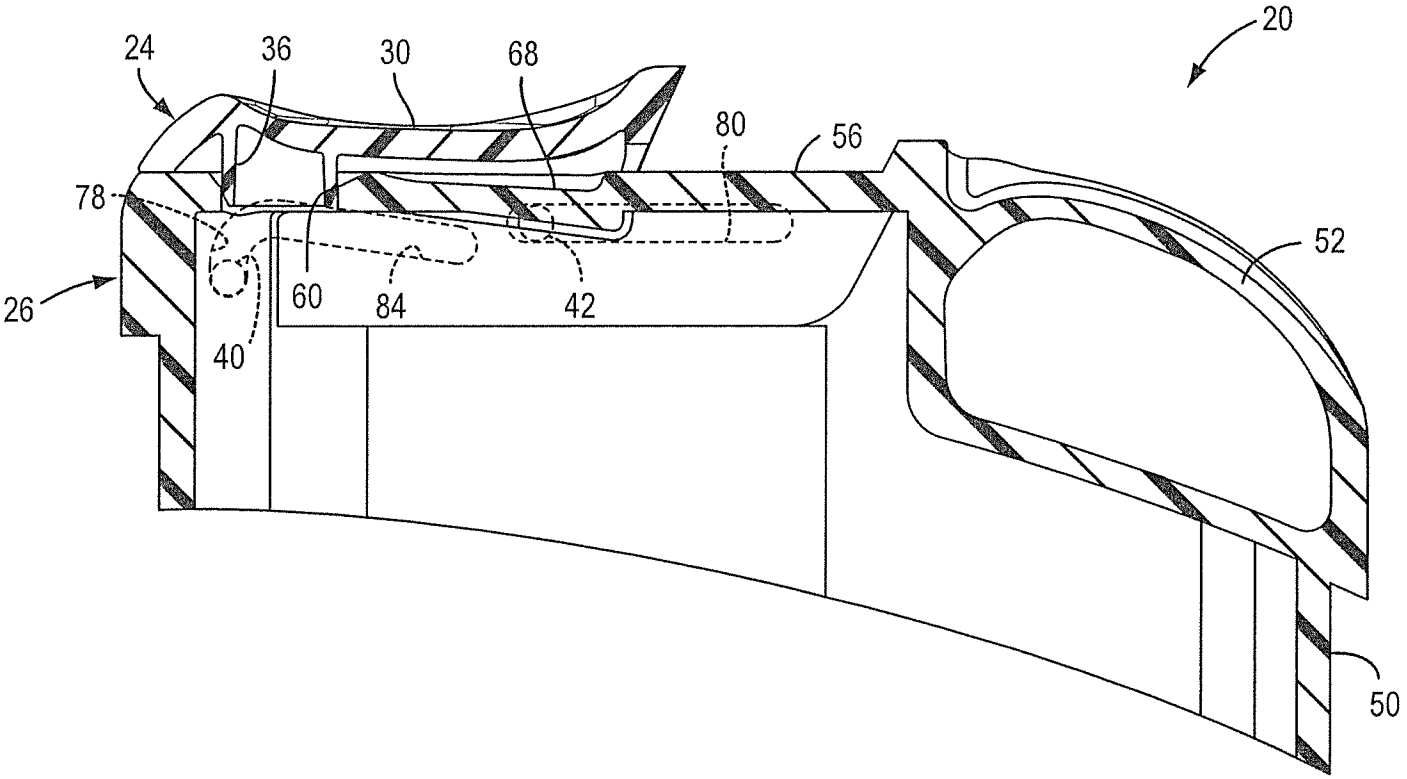
FIG. 16 is an enlarged, cross-sectional view taken generally along the plane 16-16 in FIG. 13.
Figure 17:
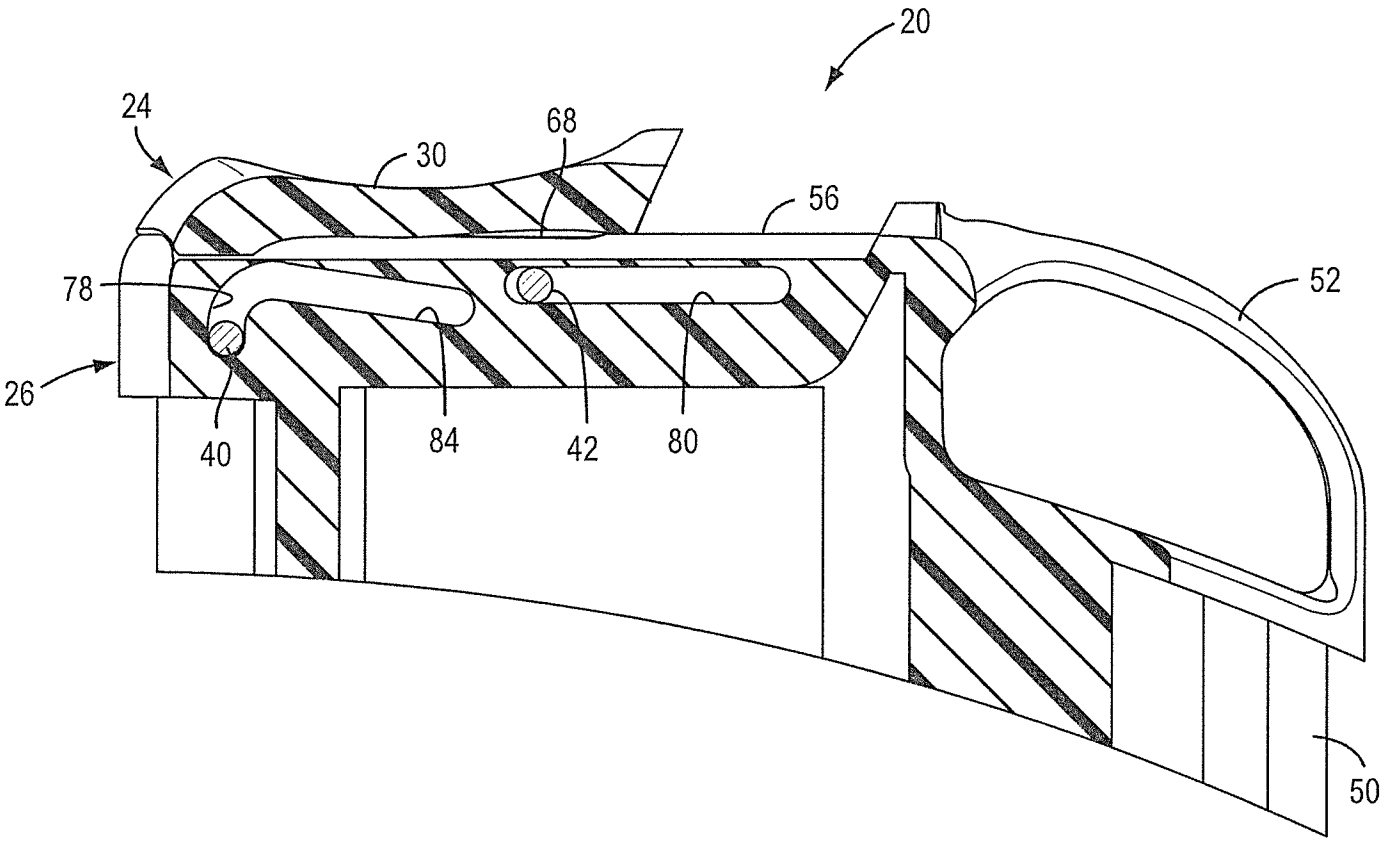
FIG. 17 is an enlarged, cross-sectional view taken generally along the plane 17-17 in FIG. 13.
Figure 18:
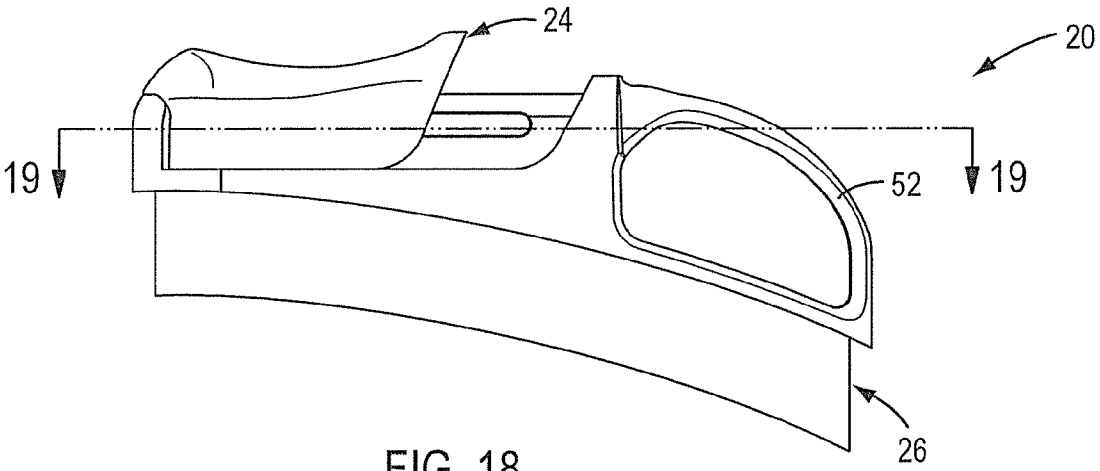
FIG. 18 is a side elevational view of the closed closure shown in FIG. 3.
Figure 19:
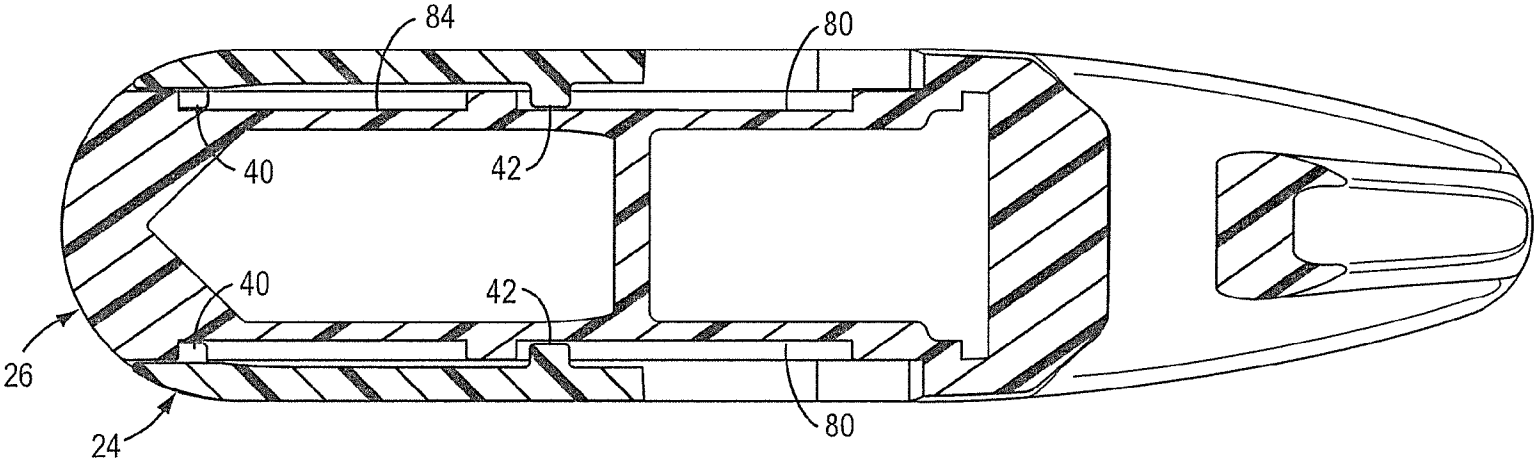
FIG. 19 is an enlarged, cross-sectional view taken generally along the plane 19-19 in FIG. 18.
Figure 20:
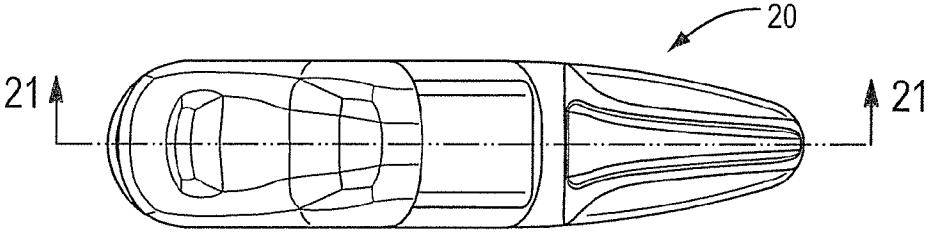
FIG. 20 is a top plan view of the closure in a partially opened condition.

When the manufacturer completes the manufacture of the closure body 26 and slider 24 (e.g., by molding each component from a suitable thermoplastic material), the manufacturer mounts the slider 24 on the closure body 26. This is readily accommodated by a slight flexibility or resiliency of the slider sidewalls 32 which can temporarily and elastically deflect slightly away from each other and onto the closure body 26 as the slider 24 is pushed downwardly onto the top of the closure body 26 so that the slider front pins 40 and slider rear pins 42 move down to, and snap into, the cam track portion cam grooves. In particular, as can be seen in FIGS. 15-17 and 19, the slider front cam follower front pins 40 are received in the bottom end of the front cam track portion front cam grooves 78 when the slider 24 is properly installed in the fully closed position on the closure body 26. Also, as can be seen in FIGS. 16, 17, and 19, when the slider 24 is properly installed on the closure body 26 in the fully closed position, the slider rear cam follower rear pins 42 are received in the rear cam track portion rear cam grooves 80.

The assembled closure components—the slider 24 and the closure body 26—together constitute the closure 20 which can then be installed on a container that has already been filled with a product or that can subsequently be filled with a product, and thereafter the container which has been filled with the product and which has been closed with the closure 20 may be characterized as a "package" ready for use.

Figure 21:
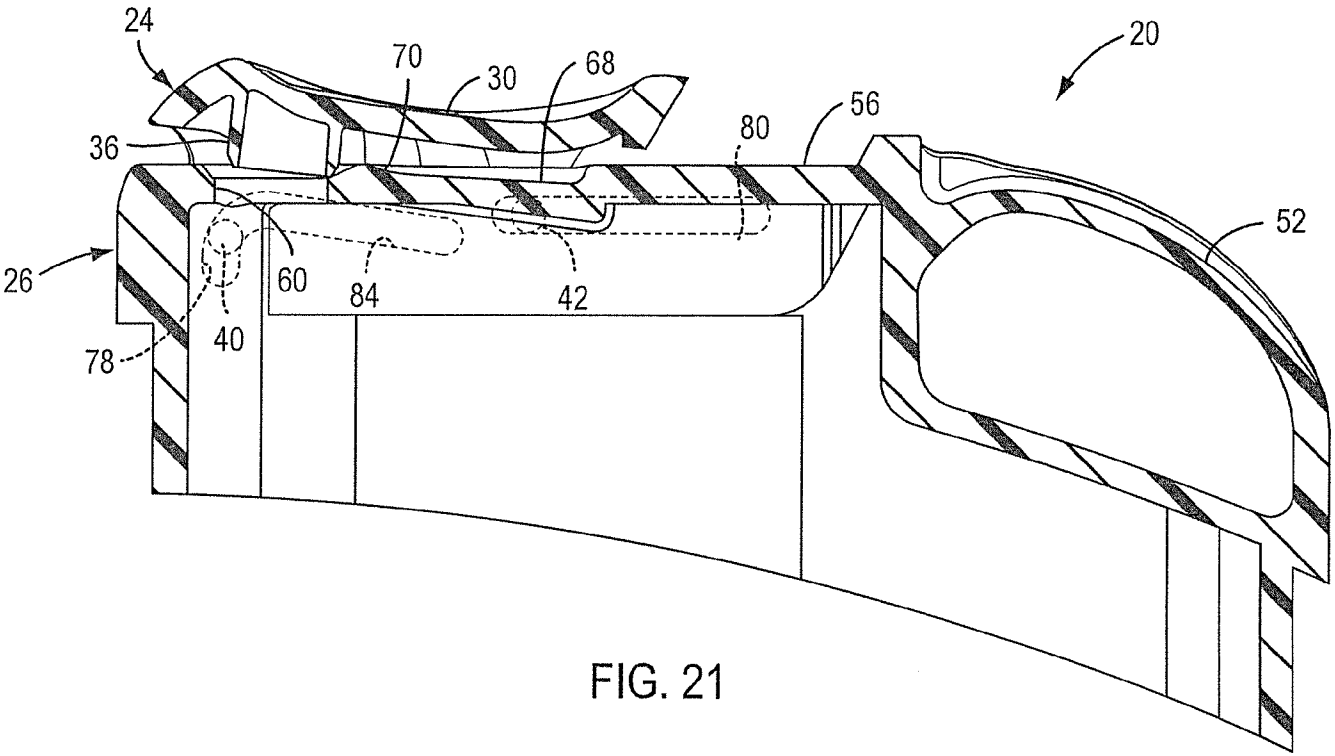
FIG. 21 is an enlarged, cross-sectional view taken generally along the plane 21-21 in FIG. 20.
Figure 22:
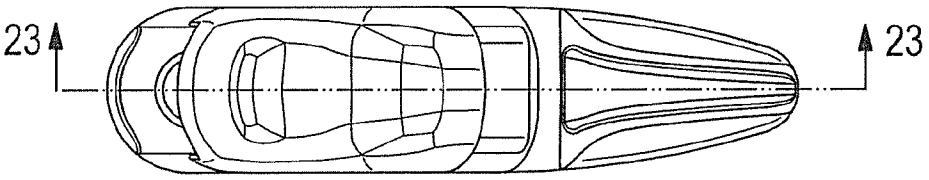
FIG. 22 is a top plan view of the closure shown in FIG. 20, but in FIG. 22 the closure has been moved to a further opened condition compared to FIG. 20.

A user of the package who wishes to open the package may apply a force to the closure slider engageable platform 30 (FIGS. 3, 16, and 17) in a direction that acts generally somewhat downwardly as well as rearwardly along the top of the closure 20 toward the handle 52. As a lateral and downward force is applied to the slider 24, the slider pins 40 and 42 move in their respective cam grooves. In particular, the slider front pins 40 are guided upwardly in the cam grooves 78 and then rearwardly and downwardly in the intermediate cam grooves 84 while the slider rear pins 42 are guided rearwardly in the rear cam grooves 80 (FIG. 21). As the user begins to push the slider 24 rearwardly, the user will also exert some downward force on the engageable platform 30 of the slider 24. When the slider 24 is initially in the fully closed position, the downward force applied by the user to the top rear portion of the slider 24 will cause the slider 24 to pivot on the rear cam follower pins 42 so that the front of the slider 24 is lifted upwardly or outwardly away from the access aperture 60. The raised portion 31 at the rear of the slider 24 directs the user to push on the recessed area defining the engageable platform 30 adjacent the raised portion 31 so as to apply a force with the necessary downward component as well as a rearward component so as to move the slider 24 rearwardly and so as to simultaneously pivot the slider 24 so that the front of the slider 24 moves upwardly away from the access aperture 60. As can be seen in FIG. 21, the front of the slider 24 pivots upwardly about the axis of the rear pins 42 so as to raise the projecting plug 36 out of the access aperture 60.

Figure 23:
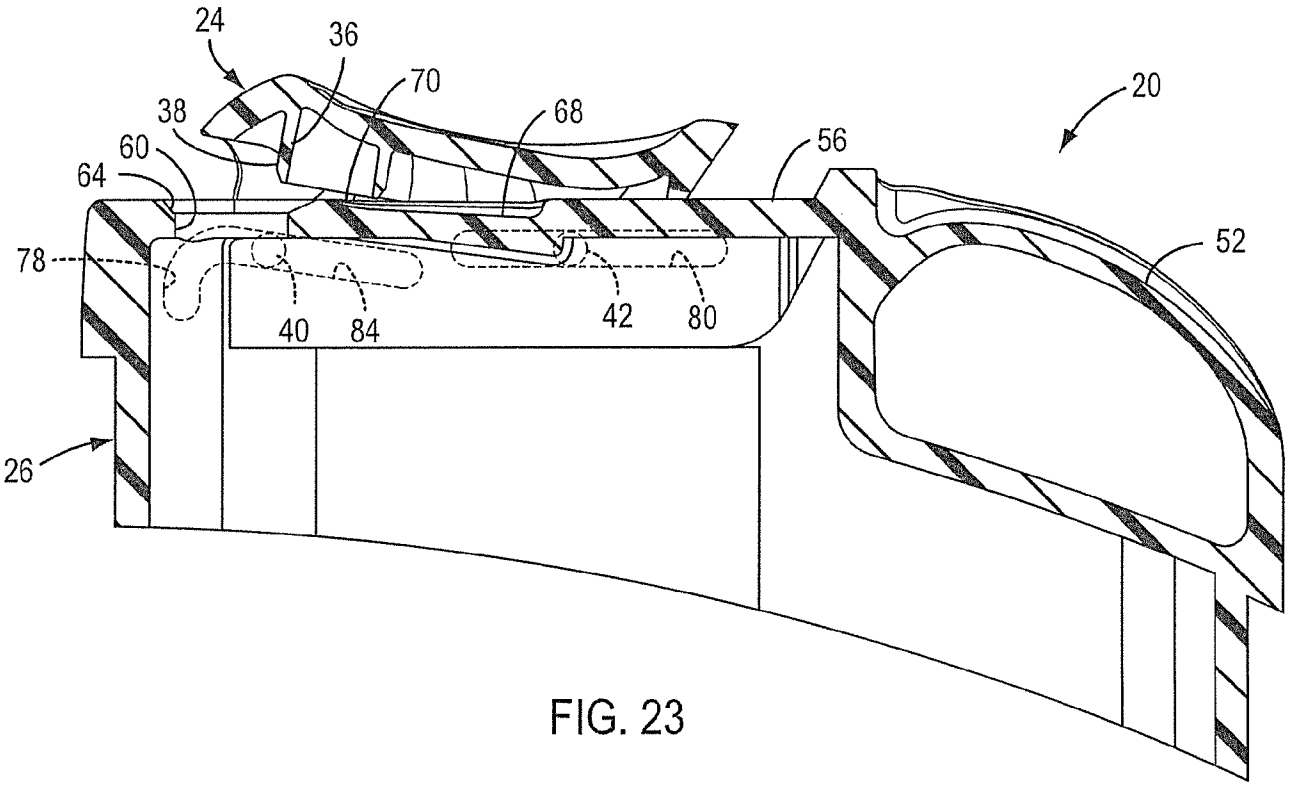
FIG. 23 is an enlarged, cross-sectional view taken generally along the plan 23-23 in FIG. 22.
Figure 27:
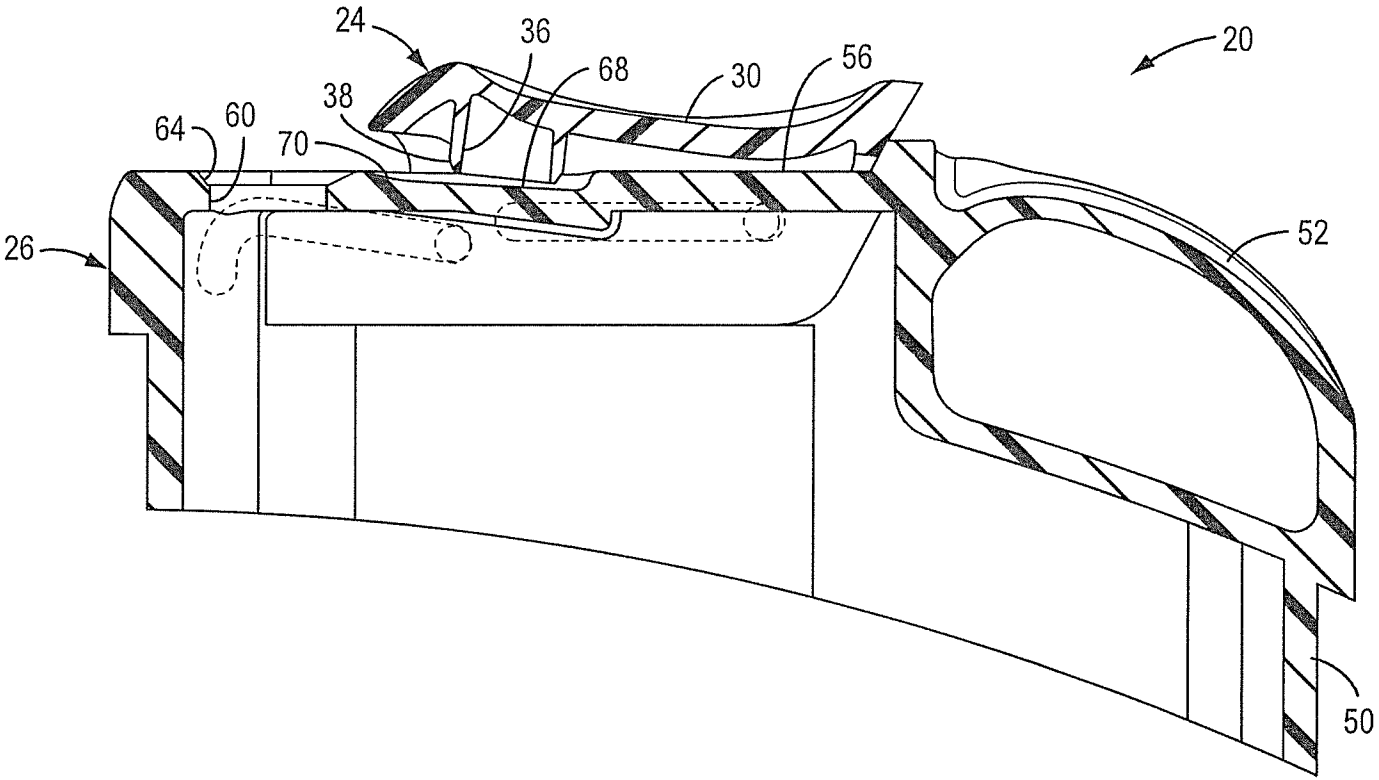
FIG. 27 is an enlarged, cross-sectional view taken generally along the plane 27-27 in FIG. 25.
Figure 28:
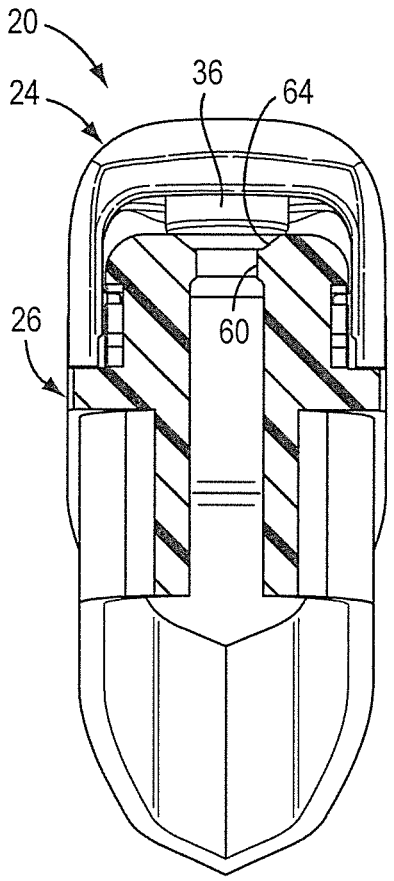
FIG. 28 is an enlarged, cross-sectional view taken generally along the plane 28-28 in FIG. 25.
Figure 29:
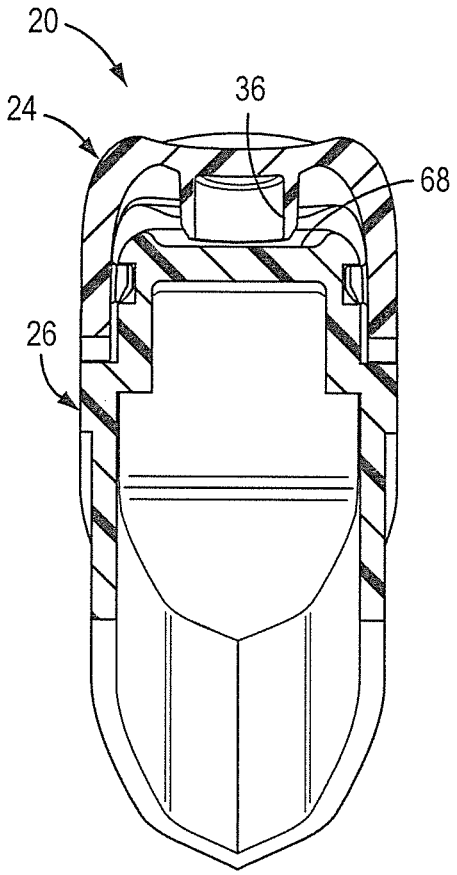
FIG. 29 is an enlarged, cross-sectional view taken generally along the plane 29-29 in FIG. 25.

With reference to FIG. 23, as the slider 24 continues to be moved rearwardly on the closure body 26, the plug 36 begins to move over the closure body deck 56 and into the recess 68 in the top of the closure body deck 56. As can be seen in FIGS. 23, 24, 26, and 27, the slanted surface 70 on the closure body deck 56 accommodates the travel of the slider plug 36 rearwardly and downwardly into the recess 68 as the slider front pins 40 on each side of the slider 24 move along the downwardly slated intermediate cam grooves 84 when the slider 24 moves to the fully opened position (FIGS. 24 and 27).

When the slider 24 is in the fully opened position, the friction existing between the surfaces of the slider 24 and closure body 26 is sufficient to hold the slider 24 in the fully opened position during normal handling of the opened package by the user. In addition, a detent arrangement (not illustrated) could be used for holding the slider 24 open.

After the user has discharged, or otherwise removed, the desired amount of contents from the container through the opened closure 20, the user can push the slider 24 forwardly to the fully closed position (FIGS. 1, 3, 15, and 16) wherein the plug 36 is once again seated in the access aperture 60 to sealingly engage closure body 26 around the access aperture 60.

It will also be appreciated that the upper surfaces of the first embodiment of the closure 20 illustrated in FIGS. 1-29 may be modified so as to present a surface, or a number of separated surfaces, that lie in a flat plane along the top of the closure so as to permit the closure to be turned upside down and placed on a counter or table in a vertical, but upside down, orientation.

It will also be appreciated that the closure 20 accommodates a relatively thin design that is especially suitable for use with thin packages such as flexible pouches or such as thin, rigid wall containers. A relatively thin closure and container can be used to create a relatively thin package which a user may find convenient for carrying in a pocket or purse.

Figure 30:
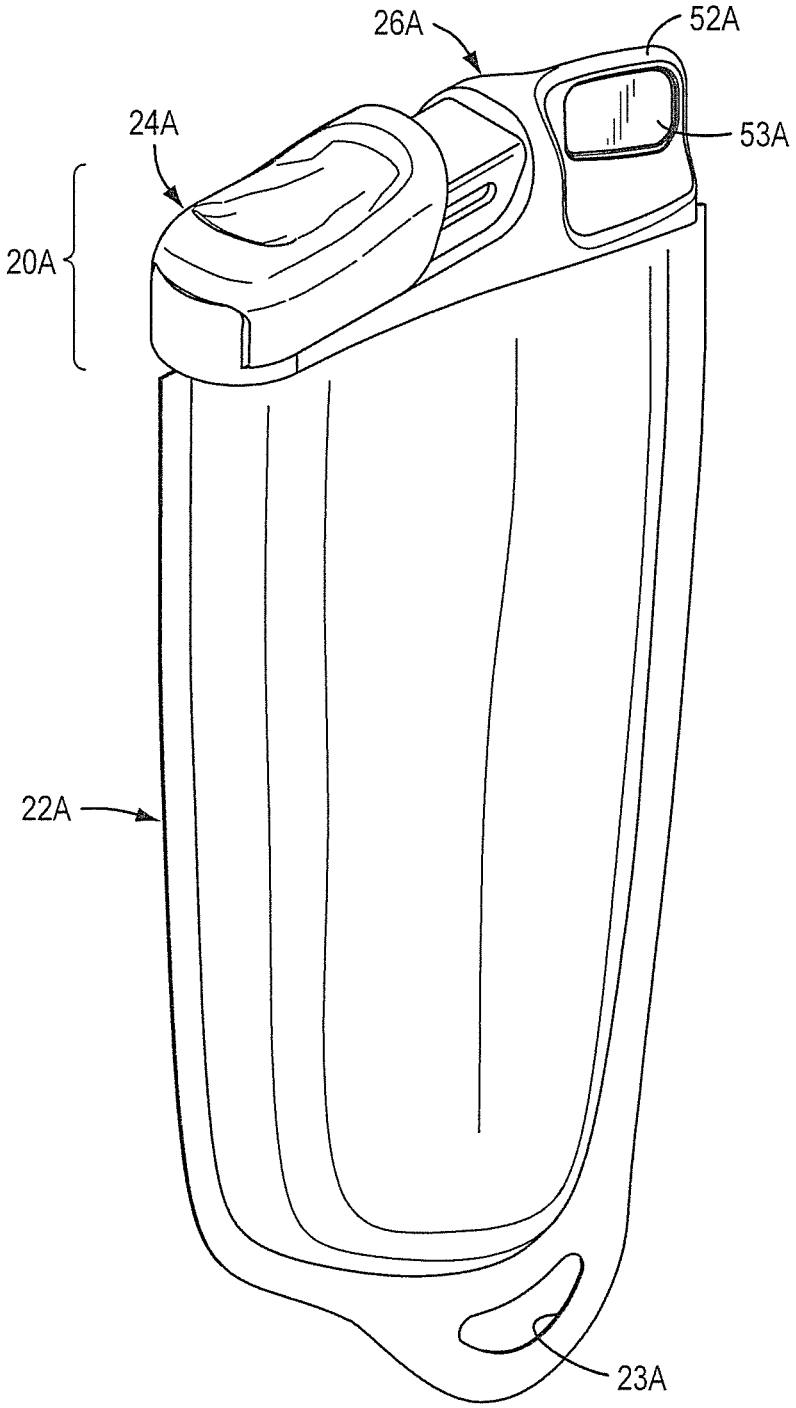
FIG. 30 is an isometric view of second embodiment of the closure of the present invention shown on a modified form of the pouch type of container illustrated in FIG. 1.

FIG. 30 shows a second embodiment of a closure of the present invention wherein the second embodiment of the closure is designated generally by the reference number 20A. The second embodiment of the closure 20A is shown installed on a flexible pouch type of container 22A. The container 22A is generally the same as the container 22 discussed above with reference to FIG. 1 except that the container 22A in FIG. 30 includes a loop at the bottom which defines an aperture 23A which is adapted to receive hook or other member from which the container 22A may be hung in an inverted position.

The second embodiment of the closure 20A is generally similar to the first embodiment of the closure 20 discussed above with reference to FIGS. 1-29. The second embodiment of the closure 20A differs from the first embodiment of the closure 20 in that the second embodiment of the closure 20A has a somewhat more rectangular shaped handle 52A, and the interior of the handle 52A presents a solid wall 53A. In contrast, the handle 52 of the first embodiment of the closure 20 has an open aperture through the handle 52.

Except for the structure of the handle 52A and solid wall 53A, the second embodiment of the closure 20A is identical with, and functions in the same manner as, the first embodiment of the closure 20 discussed above with reference to FIGS. 1-29.

Figure 31:
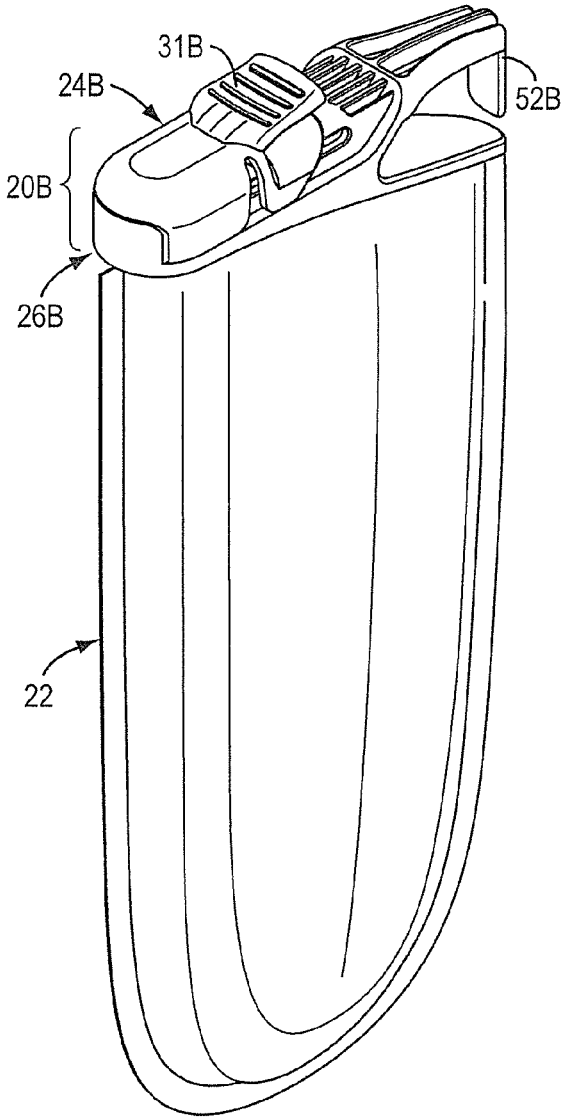
FIG. 31 is an isometric view of a presently preferred third embodiment of a closure of the present invention wherein the closure is shown installed on flexible pouch type of container with the closure in the closed condition and wherein the closed closure, container, and contents therein together define a package.

A third embodiment of a closure 20B is illustrated in FIGS. 31-57. The closure 20B is shown in FIG. 31 as installed on the top of a flexible pouch type of container 22 which is identical to the container 22 described above with reference to FIG. 1. FIG. 3 shows the closure 20B on a generally rigid container 22' (which may have somewhat flexible, resilient walls). The containers 22 or 22' have been described above in more detail with reference to FIGS. 1 and 2.

The third embodiment of the closure 20B illustrated in FIGS. 31-57 is adapted to be installed in the container 22 or 22' in the same manner as described above with respect to the installation of the first embodiment of the closure 20 on the associated container 22 or 22' as illustrated in FIGS. 1 and 2, respectively.

Like the first embodiment of the closure 20, the third embodiment of the closure 20B consists of two parts or components: a sliding seal member or slider 24B and a closure body 26B. The sliding seal member 24B may also be designated as a "slider" 24B. The closure body 26B and the slider 24B are preferably each molded separately as a unitary structure from a suitable thermoplastic material such as polypropylene or the like. Other materials may be employed instead.

In the illustrated third embodiment of the closure 20B, the lower portion of the closure body 26B has a generally boat-like peripheral configuration which is open on the bottom. However, the closure body 26B may have other configurations. For example, the lower portion of the closure body 26B might have a prism or polygon configuration adapted to be mounted to the top of a container neck having a mating configuration.

In one presently preferred form of the closure 20B, the closure body 26B and slider 24B are each molded separately as a unitary structure from a suitable thermoplastic material such as polyethylene, polypropylene, or the like. Other materials may be employed instead.

Figure 32:
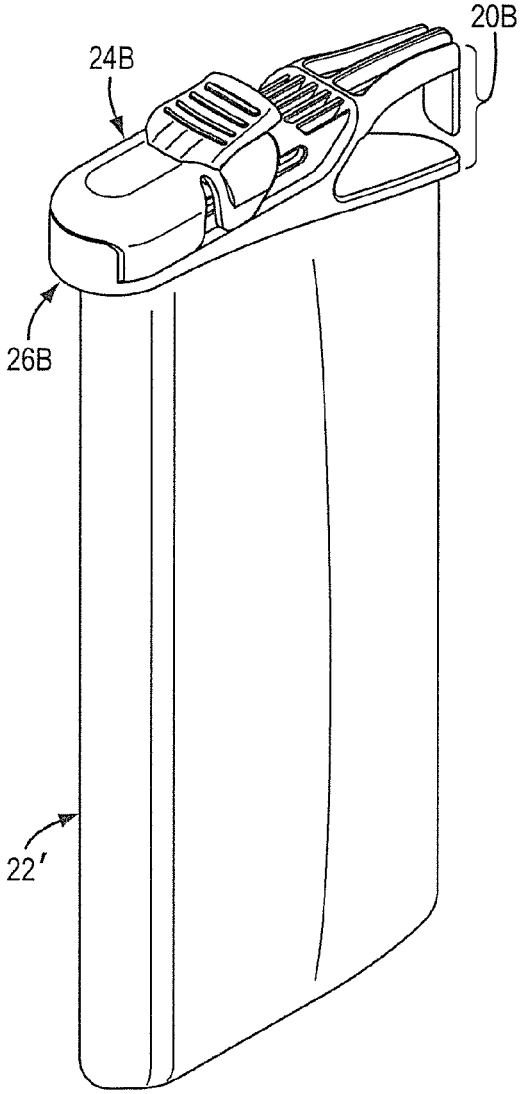
FIG. 32 is an isometric view of the same closure shown in FIG. 31, but in FIG. 32 the closure is shown installed on a semi-rigid, resilient wall container with the closure in the closed condition and wherein the closed closure, container, and contents therein together define a package.

After the closure body 24B and slider 26B are molded, the manufacturer installs the slider 26B on the closure body 24B in the closed position. The closed closure 20B would typically then be shipped to a bottler which would provide a container (e.g., container 22 or 22' as shown in FIGS. 31 and 32), and the bottler would install the closure 20B on the container 22 or 22'. The container may have already been filled with product, or the closure may be installed on an empty container which is subsequently filled with product through an open bottom end of the container which is thereafter sealed closed.

The closure 20B can be installed on the container in the same manner as described above for the first embodiment of the closure 20. Alternate attachment configurations could be provided on the closure 20B as described above for the closure 20.

Figure 33:
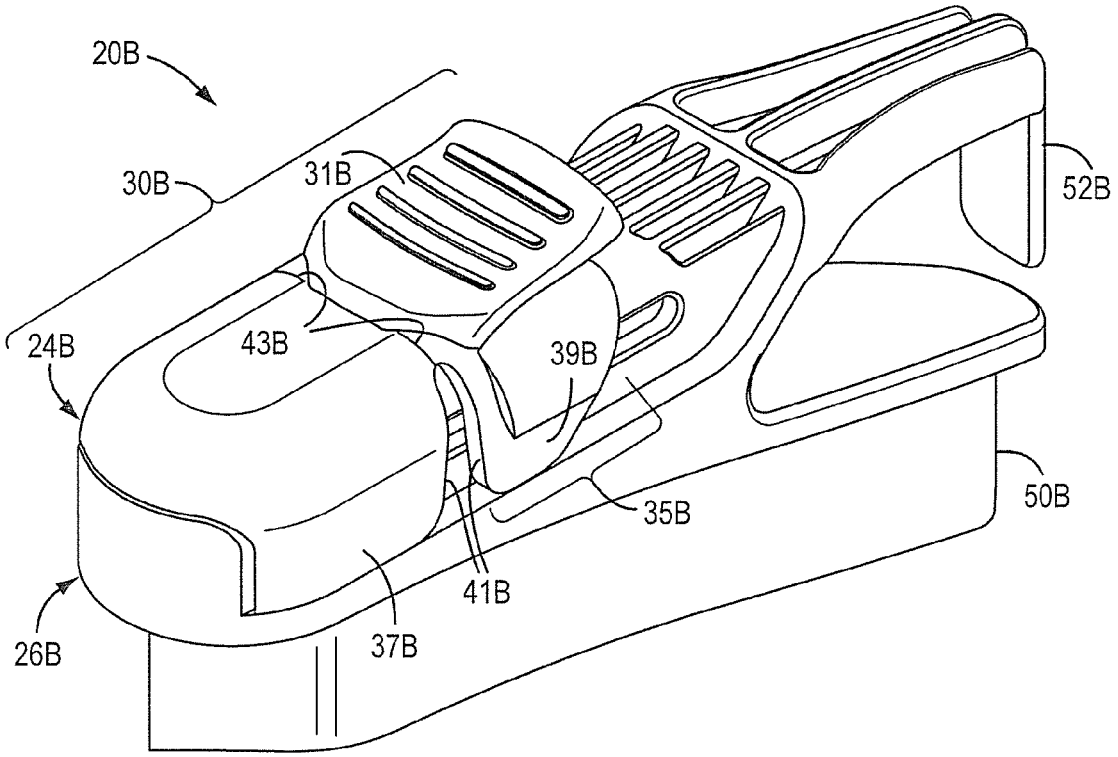
FIG. 33 is an isometric view of the third embodiment of the closure alone in the closed condition prior to installation on a container such as the container shown in FIG. 31 or the container shown in FIG. 32.
Figure 34:
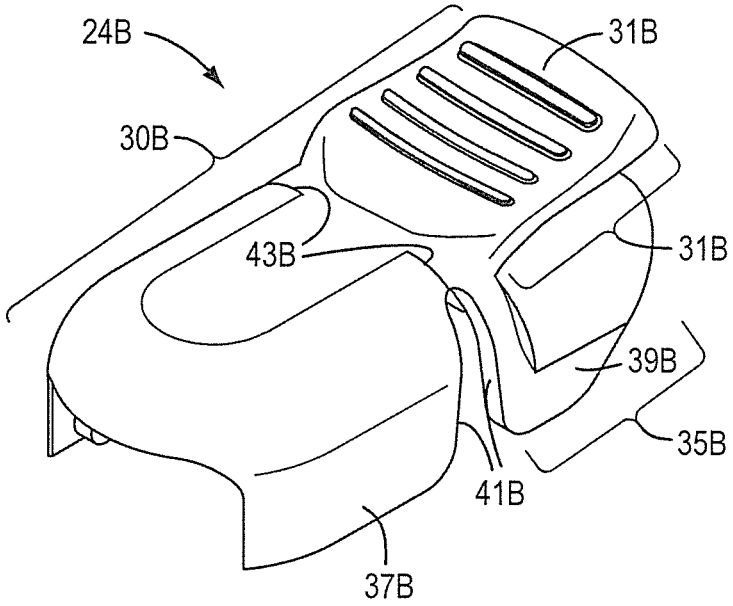
FIG. 34 is an isometric view from an upper front corner of the sliding seal member or "slider" of the closure shown in FIG. 33.
Figure 35:
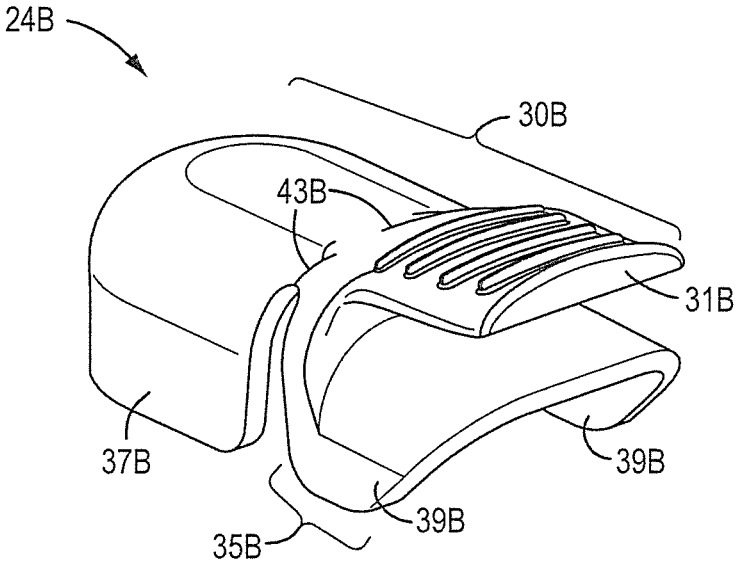
FIG. 35 is an isometric view from an upper rear corner of the slider shown in FIG. 34.

The slider 24B, which is illustrated in the closed position on the closure body 26B in FIG. 33, is separately illustrated in FIGS. 34-37. As can be seen in FIG. 34, the slider 24B has a pivotable portion 30B defining upwardly facing surfaces that include a rearwardly and upwardly extending lever 31B which can be engaged by a user's thumb or finger to effect movement of the slider 24B along the top of the closure body 26.

With reference to FIG. 34, the slider 24B can be characterized as having a lower rear base portion 35B which extends from the pivotable portion 30B. The pivotable portion 30B includes the rearwardly and upwardly extending lever 31B. The lever 31B has a distal, free end spaced above, and overlying, the base portion 35B.

The front region of the slider pivotable portion 30B has a pair of downwardly depending sidewalls 37B. The base portion 35B has a pair of downwardly depending sidewalls 39B. With reference to FIG. 34, on each side of the slider 24B, the pivotable portion sidewall 37B and the base portion sidewall 35B define between them a notch 41B which terminates adjacent the bottom of the lever 31B at an elastically deformable pivot region designated generally by the reference number 43B in FIGS. 34, 35, 47, 54, and 55.

Figure 36:
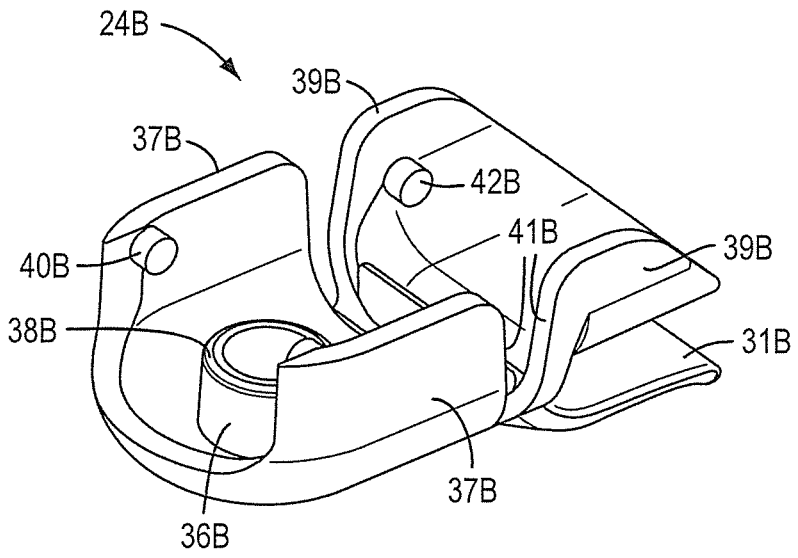
FIG. 36 is an isometric view of the underside of the slider shown in FIG. 34 as viewed from a front corner of the slider.
Figure 42:
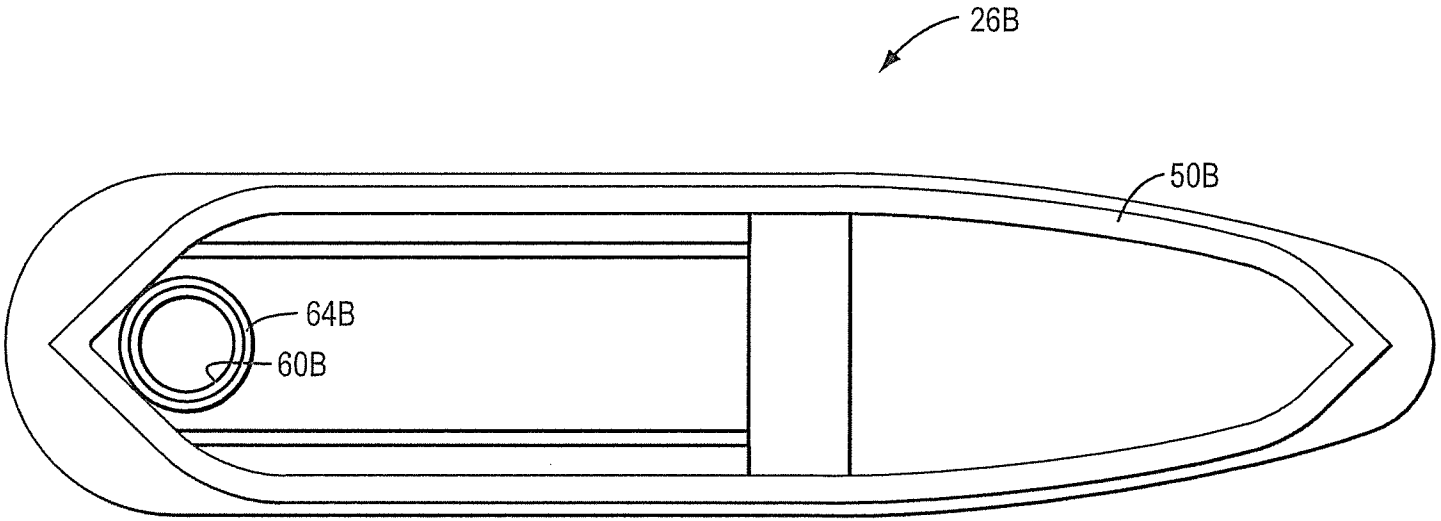
FIG. 42 is a bottom plan view of the closure body shown in FIG. 38.
Figure 43:
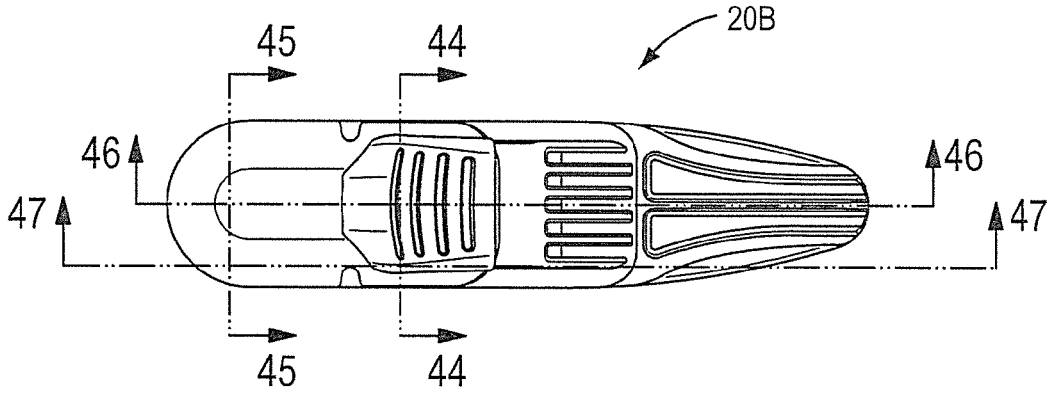
FIG. 43 is a top plan view of the closed closure shown in FIG. 33.
Figure 44:
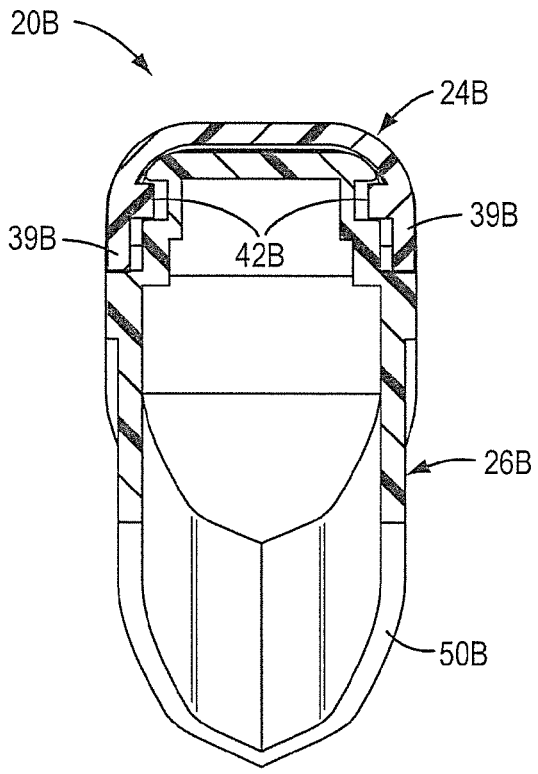
FIG. 44 is an enlarged, cross-sectional view taken generally along the plane 44-44 in FIG. 43.
Figure 55:
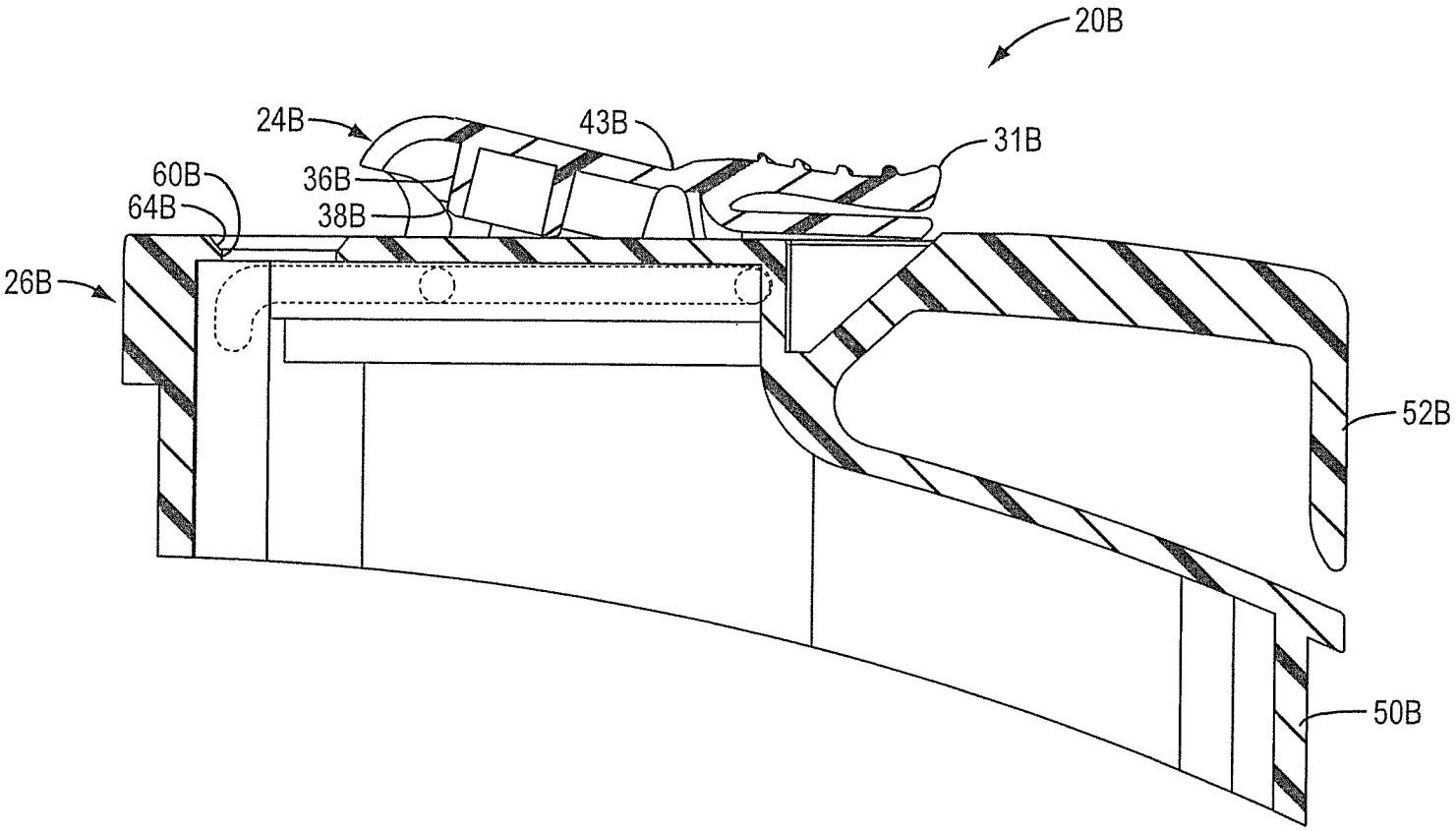
FIG. 55 is an enlarged, cross-sectional view taken generally along the plane 55-55 in FIG. 53.
Figure 56:
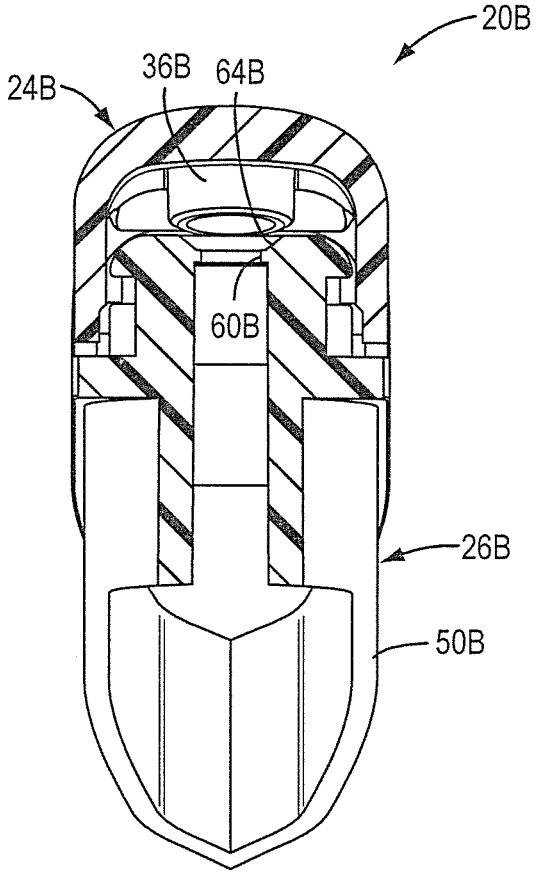
FIG. 56 is an enlarged, cross-sectional view taken generally along the plane 56-56 in FIG. 53.
Figure 57:
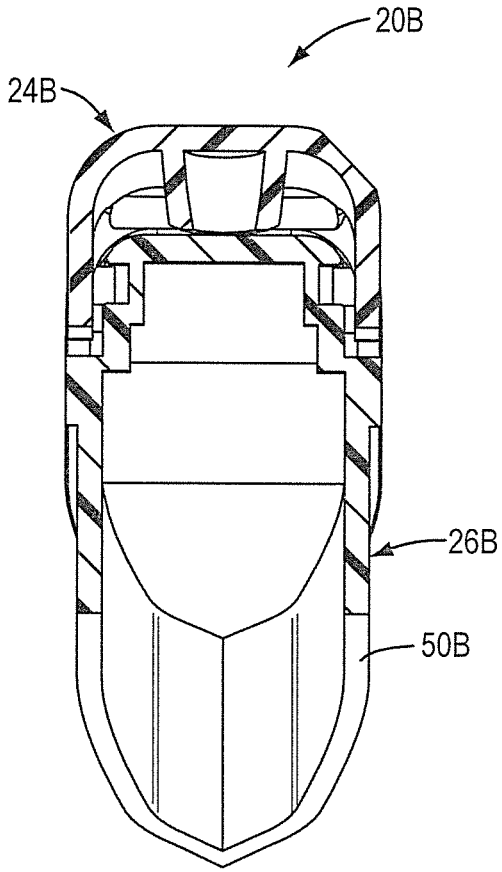
FIG. 57 is an enlarged, cross-sectional view taken generally along the plane 57-57 in FIG. 53.

As can be seen in FIG. 36, a generally cylindrical seal member in the form of a cylindrical plug 36B projects from the underside of the front part of the pivotable portion 30B between the two spaced-apart walls 37B. The cylindrical plug 36B has a slightly arcuate distal end edge 38B on the circumferential periphery of the plug 36B (FIGS. 55 and 42).

Figure 37:
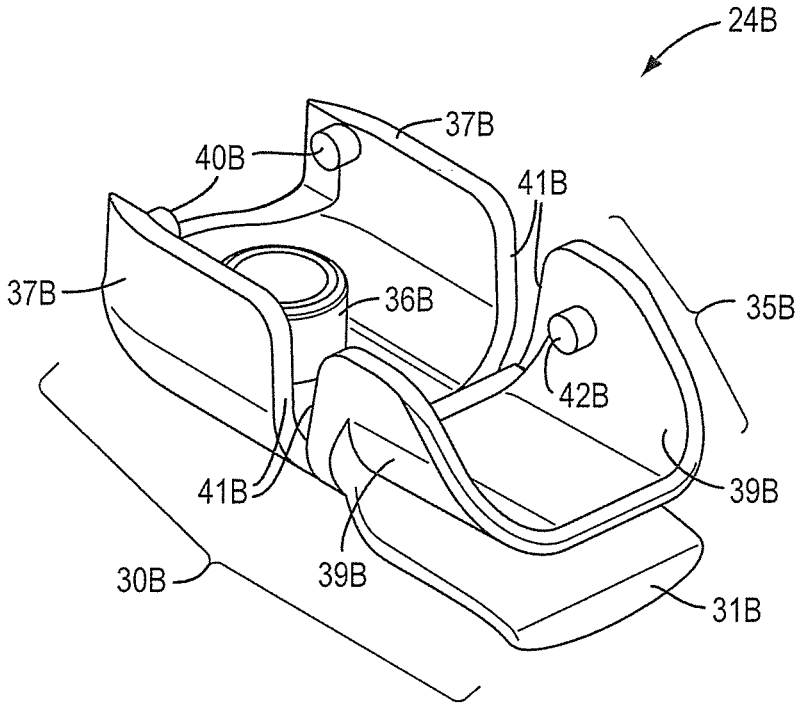
FIG. 37 is an isometric view of the underside of the slider shown in FIG. 34 as viewed from a rear corner of the slider.
Figure 51:
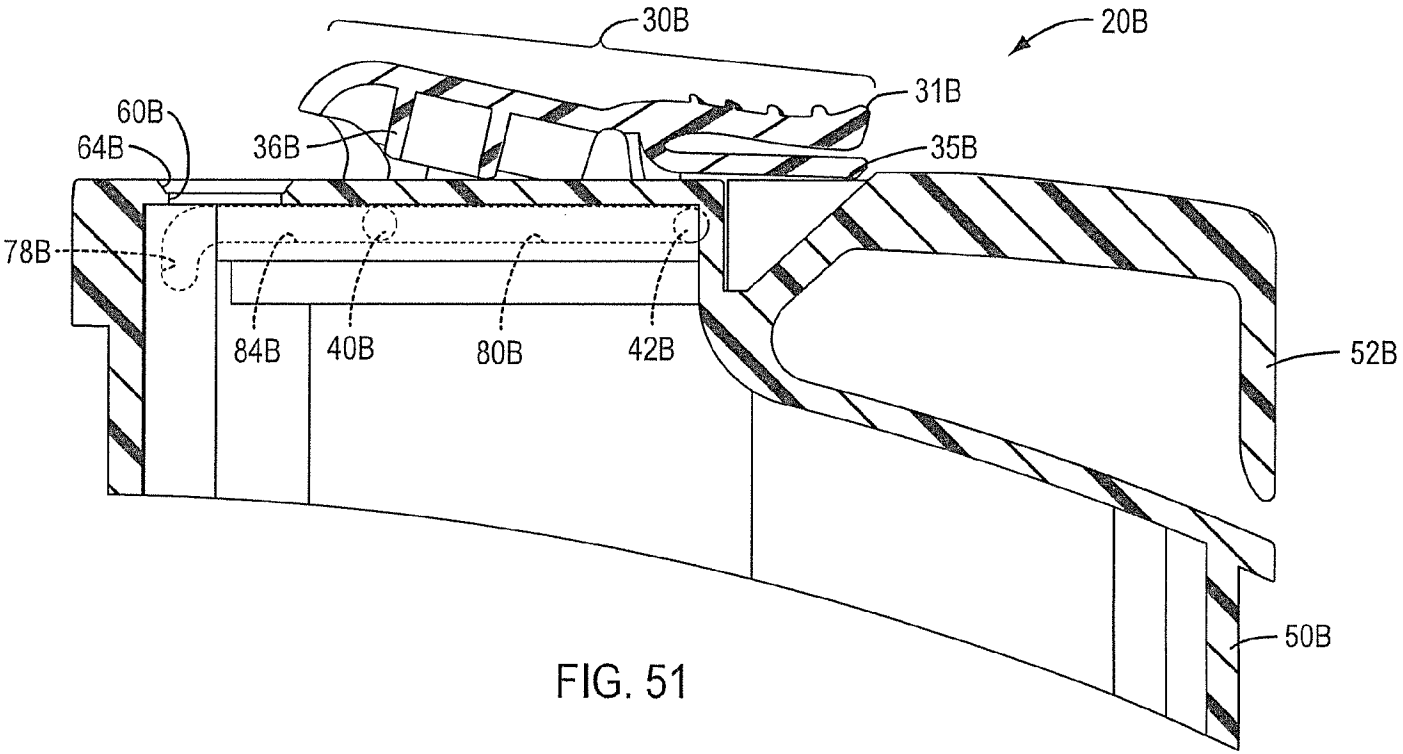
FIG. 51 is an enlarged, cross-sectional view taken generally along the plane 51-51 in FIG. 50.

With reference to FIGS. 37 and 51, each of the front walls 37B of the slider 24B has an inwardly projecting front cam follower front pin 40B. Similarly, each of the sidewalls 39B of the slider base portion 35B has a laterally projecting rear cam follower rear pin 42B.

Each of the pins 40B and 42B may be characterized as being part of cooperating guide surfaces on the body 26B and slider 24B as explained in detail hereinafter.

FIGS. 38-41 separately illustrate the closure body 26B which includes a lower peripheral wall 50B having a generally boat-shaped configuration with an open bottom end. The lower peripheral wall 50B is adapted to be engaged by, and attached to, the inside of the container (e.g., container 22 or 22'). Typically, the peripheral wall 50B would be non-removably attached to the container inside the opening at the top of the container by means of heat-sealing or with adhesive or the like.

An upper portion of the closure body 26B above the lower wall 50B includes a right angle-type handle 52B (FIG. 38) at the rear end of the closure body 26B.

The top of the closure body 26B defines a deck 56B forwardly of the handle 52B. Toward the front end of the closure body 26B, the deck 56B defines at least one access aperture 60B that extends through the thickness of the deck 56B for establishing communication between the interior of the closure body 26B and the exterior of the closure body 26B. When the closure 20B, comprising the assembly of the slider 24B and closure body 26B, is properly installed on the container, the interior of the closure body 26B below the access aperture 60B is in communication with the interior of the container (e.g., container 22 or 22').

Figure 38:
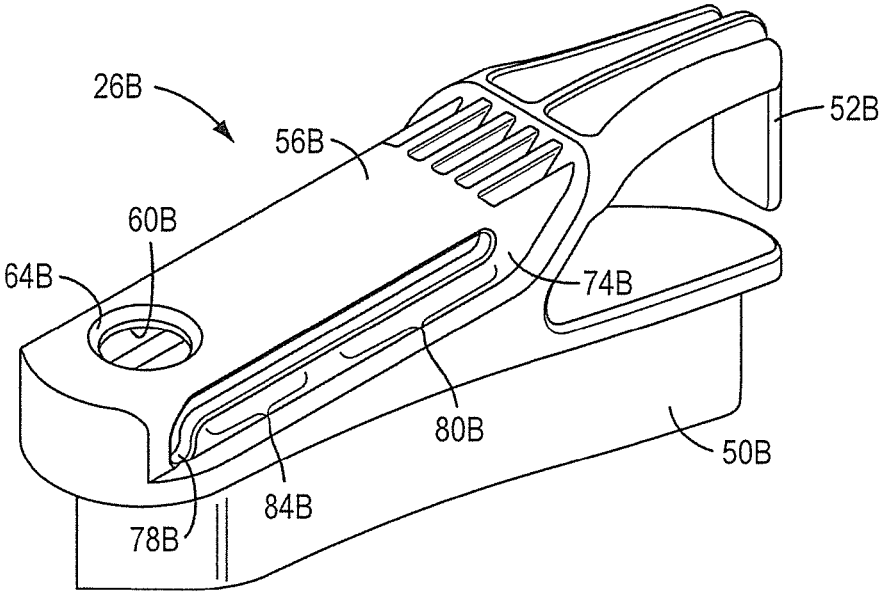
FIG. 38 is an isometric view from an upper front corner of the closure body of the closure shown in FIG. 33.
Figure 39:
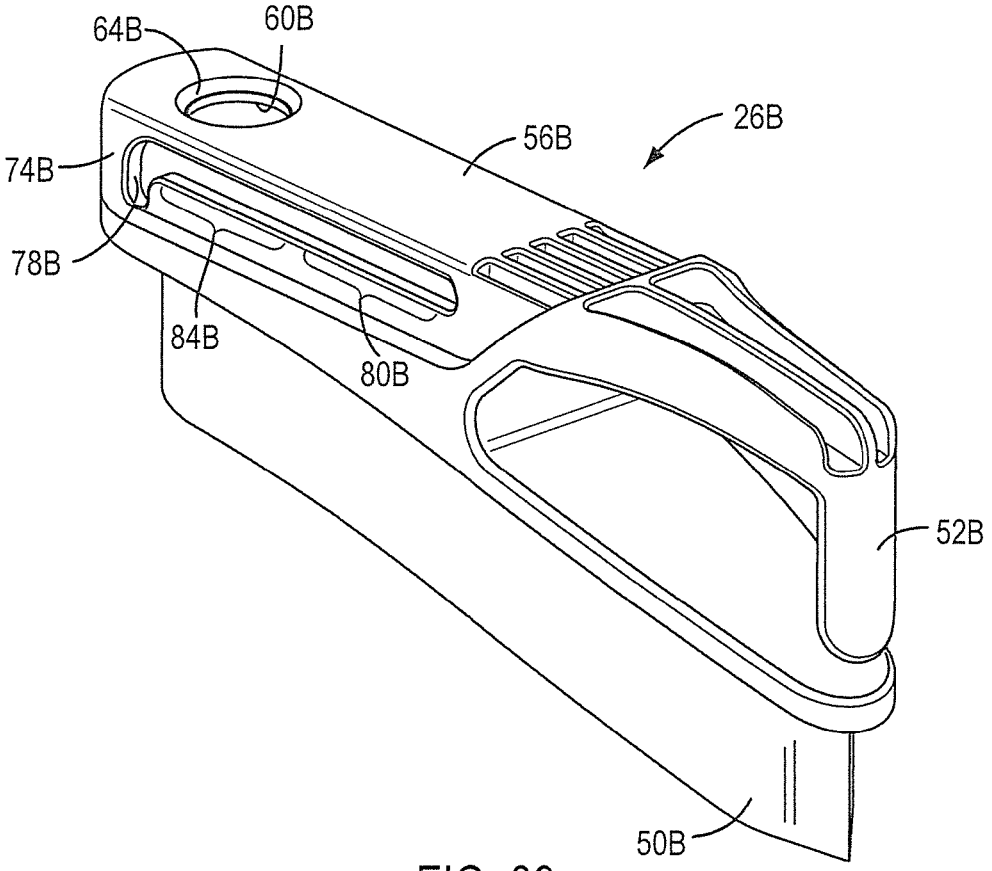
FIG. 39 is an isometric view from an upper rear corner of the closure body shown in FIG. 38.
Figure 40:
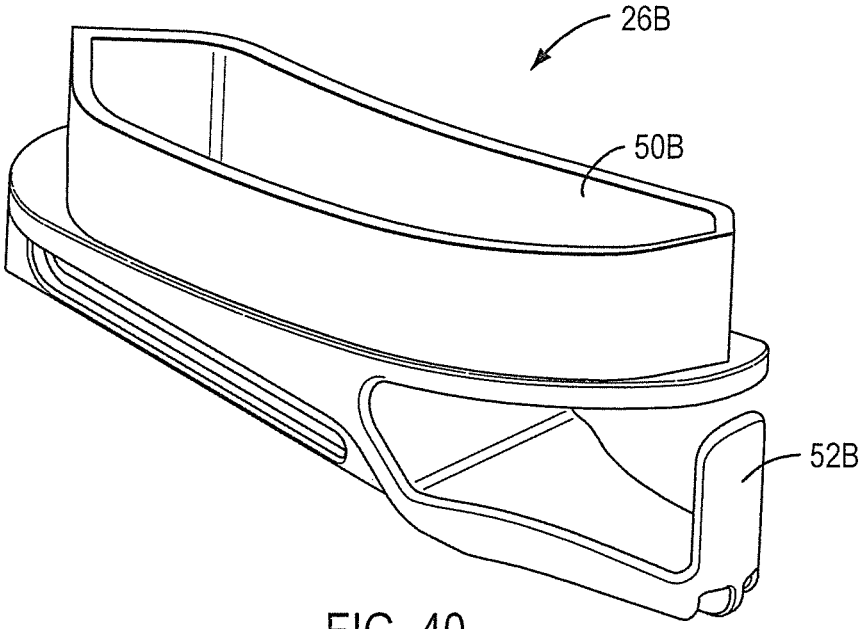
FIG. 40 is an isometric view of the underside of the closure body shown in FIG. 38 as viewed from a rear corner of the closure body.
Figure 41:
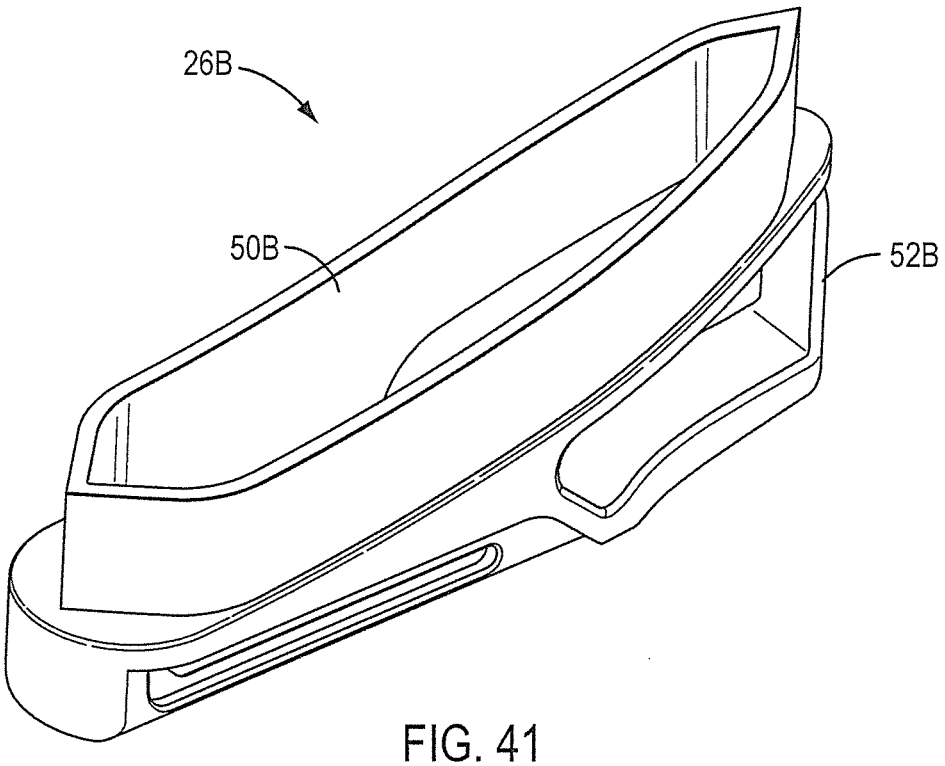
FIG. 41 is an isometric view of the underside of the closure body shown in FIG. 38 as viewed from a front corner of the closure body.

As can be seen in FIGS. 38 and 39, the upper portion of the closure body 26B includes two outwardly facing sides 74B. Each side 74B defines cooperating guide surfaces which, in the preferred embodiment illustrated in FIGS. 38 and 39, consist of (A) a front cam track portion in the form of a front cam groove 78, (B) a rear cam track portion in the form of a rear cam groove 80, and (C) an intermediate cam track portion in the form of an intermediate cam groove 84.

Figure 46:
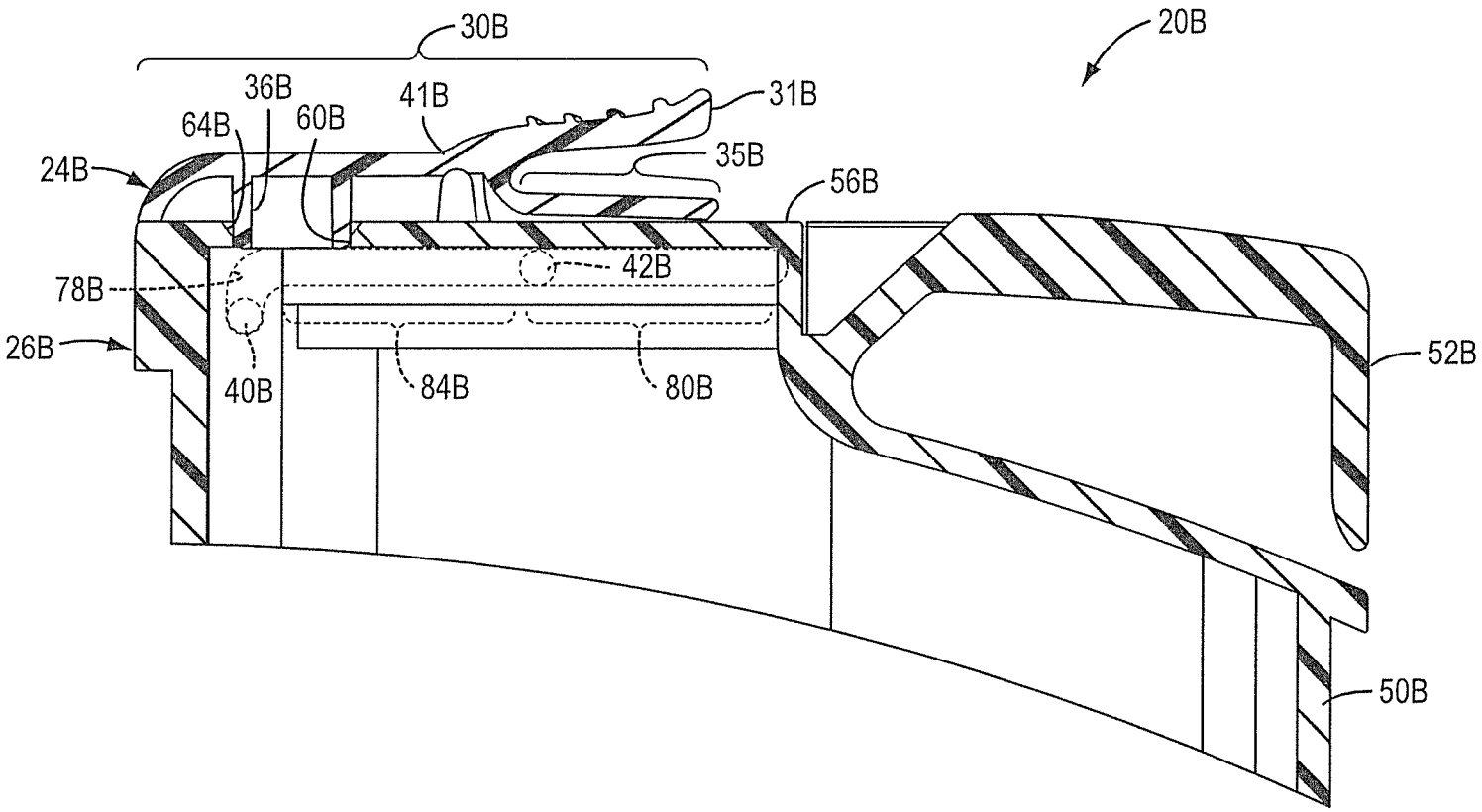
FIG. 46 is an enlarged, cross-sectional view taken generally along the plane 46-46 in FIG. 43.
Figure 47:
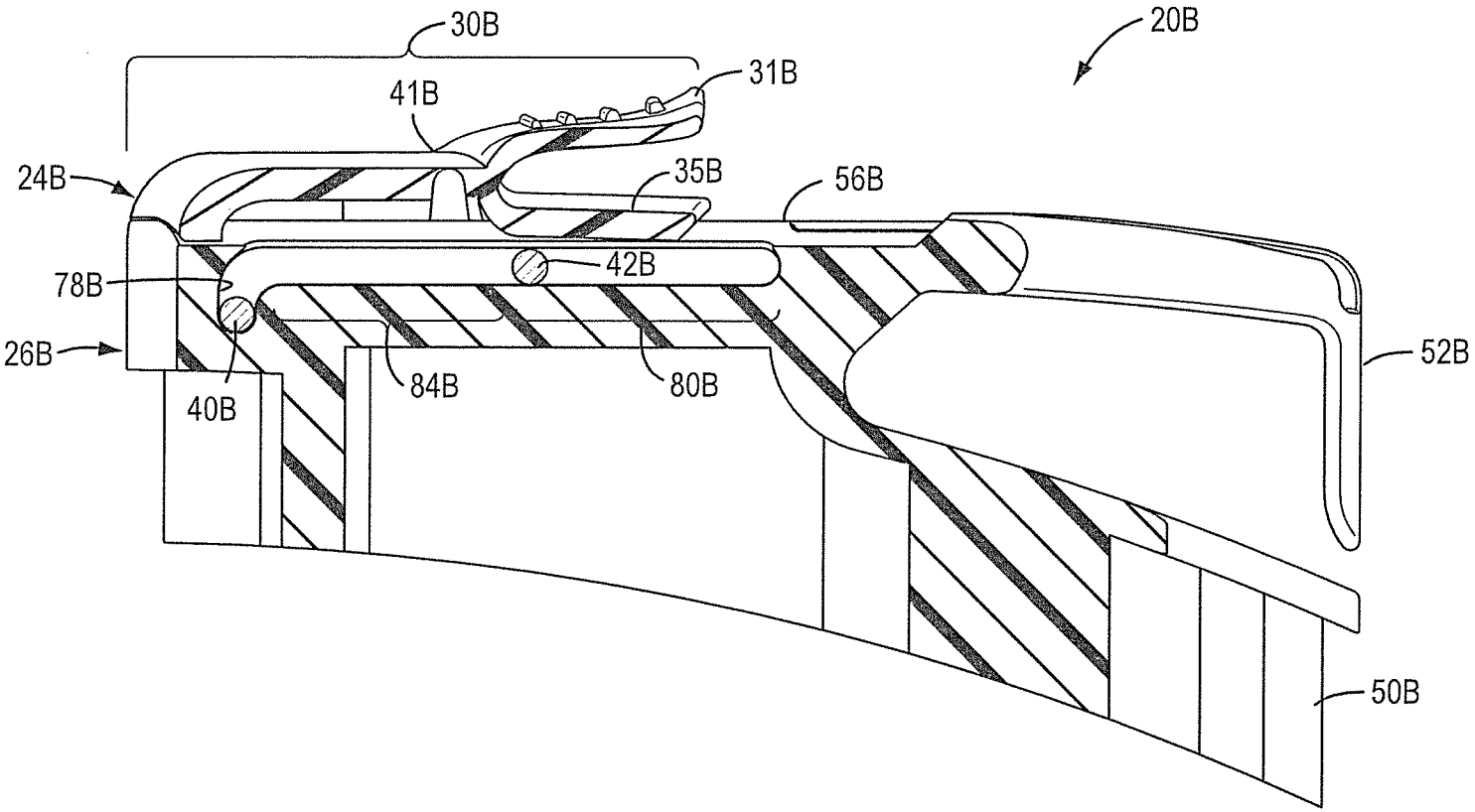
FIG. 47 is an enlarged, cross-sectional view taken generally along the plane 47-47 in FIG. 43.
Figure 48:
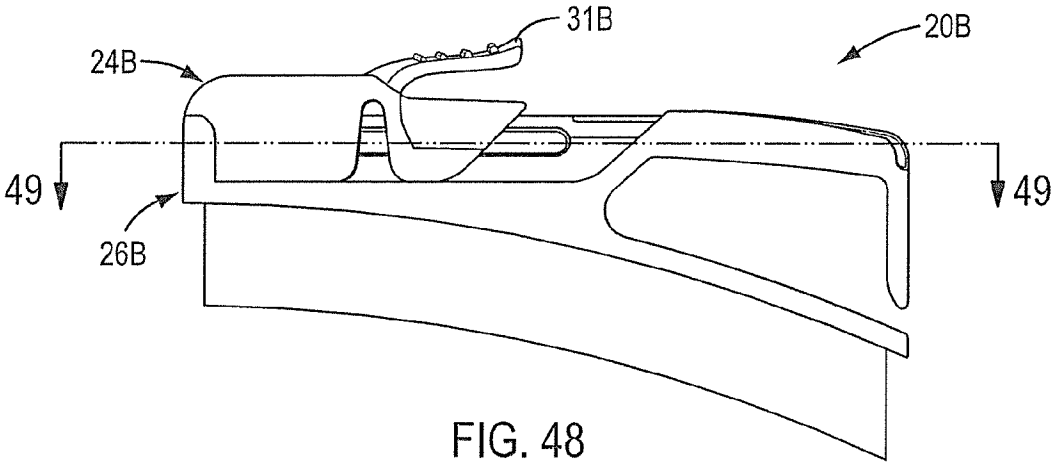
FIG. 48 is a side elevational view of the closed closure shown in FIG. 33.
Figure 49:
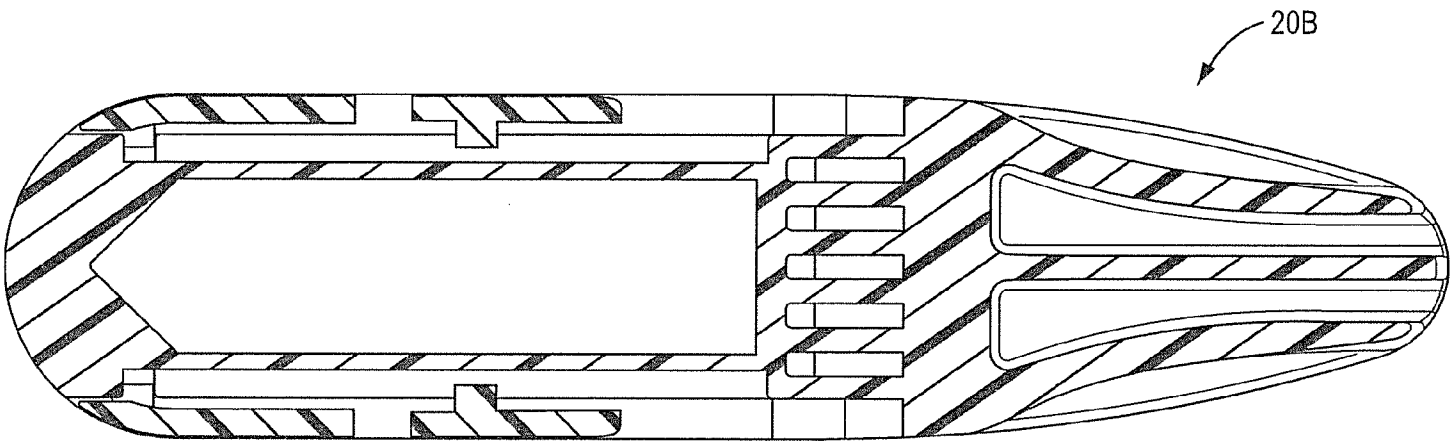
FIG. 49 is an enlarged, cross-sectional view taken generally along the plane 49-49 in FIG. 48.
Figure 50:
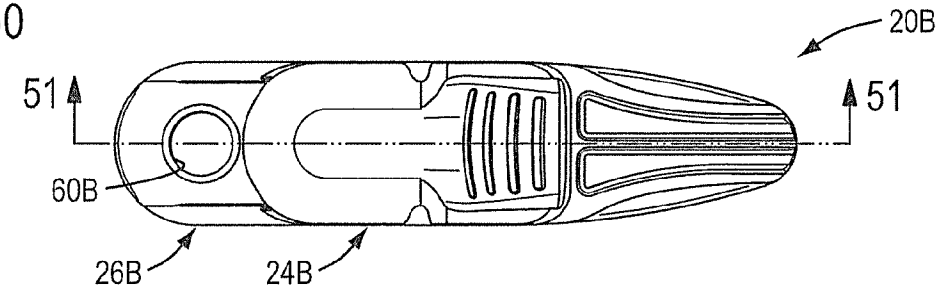
FIG. 50 is a top plan view of the third embodiment the closure in a partially opened condition.

As can be seen in FIGS. 39, 46, and 47, the front cam groove 78B, the intermediate cam groove 84B, and the rear cam groove 80B together define a single continuous groove. The portions of the single continuous groove defined by the front cam groove 78B and the intermediate cam groove 84B are adapted to receive one of the slider cam follower front pins 40B, whereas the portion of the single continuous groove defined by the rear cam groove 80B is adapted to receive one of the slider rear cam follower rear pins 42B.

Figure 52:
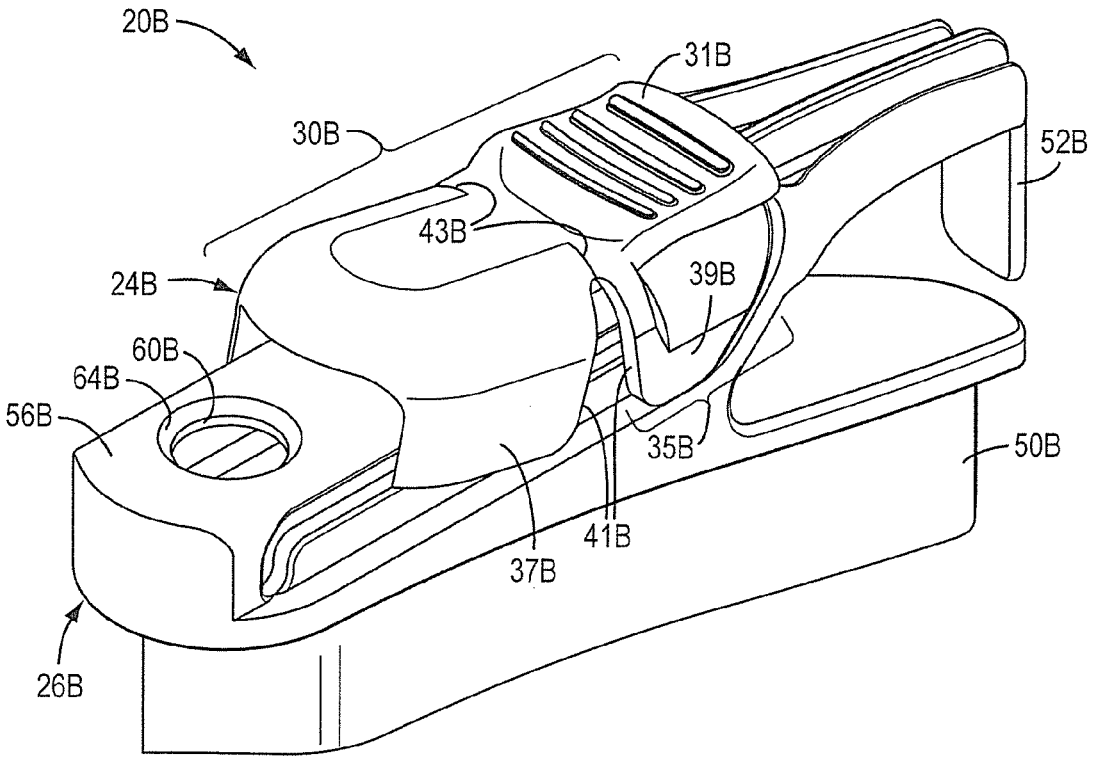
FIG. 52 is an isometric view of the third embodiment of the closure in a fully opened condition.
Figure 53:
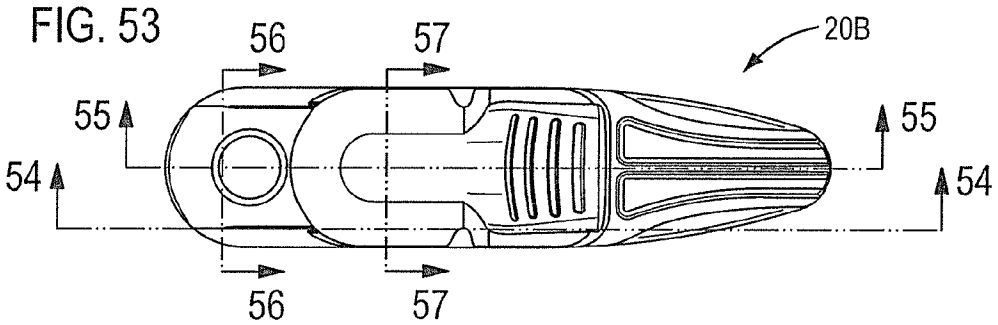
FIG. 53 is a top plan view of the fully opened closure shown in FIG. 52.
Figure 54:
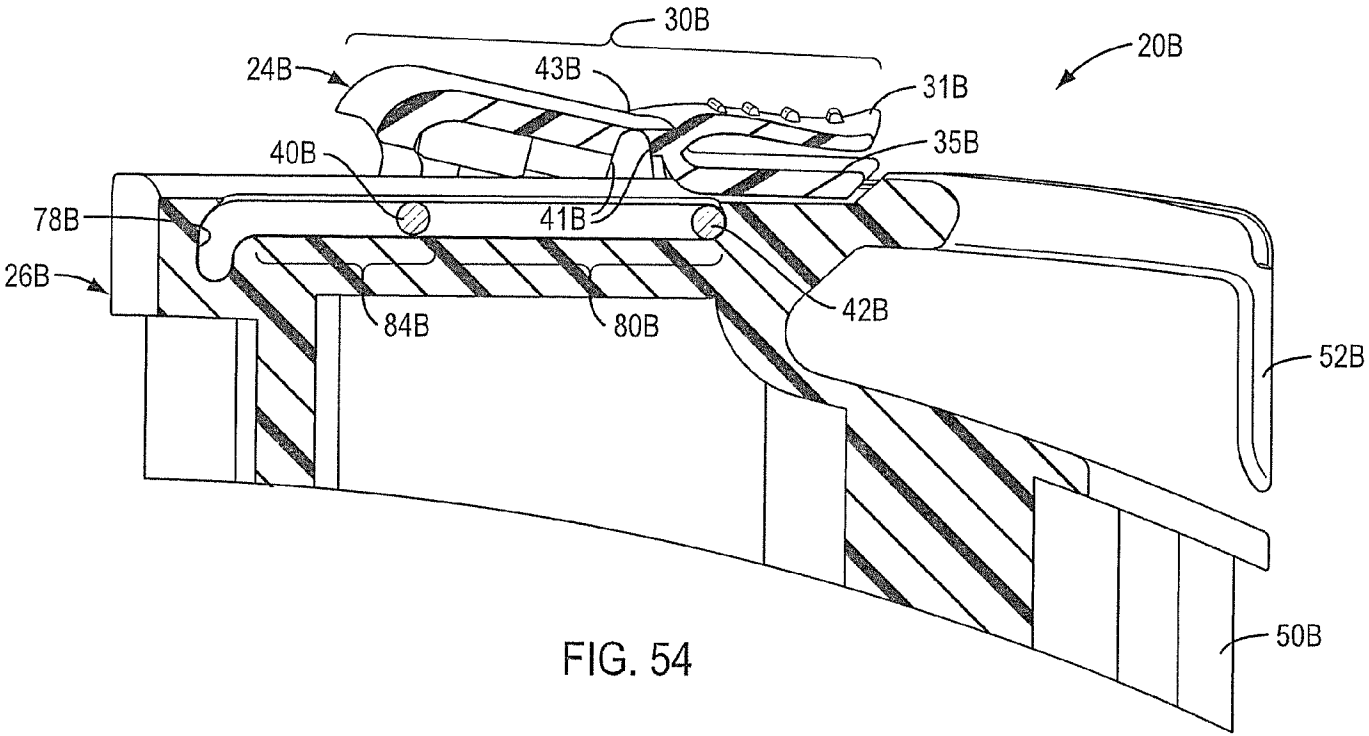
FIG. 54 is an enlarged, cross-sectional view taken generally along the plane 54-54 in FIG. 53.

The front cam track portion front cam groove 78B is oriented generally vertically relative to the height of the closure body 26B. The front cam track portion front cam groove 78B may be described as extending in a discharge direction wherein the discharge direction is the direction from which contents can be removed through the access aperture 60B from the inside of the closure body 26B when the closure slider 24B is moved to the fully opened position (FIG. 52). (The contents may be removed from a container to which the closure 20B is mounted by a number of different removal methods depending upon the nature of the contents, the size of the access aperture 60B, and other factors. For example, if the closure 20B is installed on a flexible, collapsible pouch type of container 22B, then the container 22B and opened closure 20B could be tipped generally upside down, and the contents could be allowed flow out of the open access aperture 60B under the influence of gravity and/or with the assistance of the user squeezing on the container 22B to force the contents out of the collapsible container. On the other hand, if the container is relatively large, and if the closure 20B is relatively large and has a relatively large access aperture 60B, then the contents could be withdrawn from the container through the open aperture 60B with a scoop, ladle, or by hand. In any event, passage of the contents from the container through the closure access aperture 60B defines a discharge direction.)

The discharge direction is generally in the direction out of and away from the access aperture 60B. Thus, the front cam track portion front cam groove 78B may be characterized as extending in the discharge direction from the bottom, distal end of the front cam groove 78B upwardly or outwardly to the top of the front cam groove 78B where the front cam groove 78B merges with, or extends into, the forward end of the intermediate cam track portion intermediate cam groove 84B.)

The intermediate cam track portion intermediate cam groove 84B is located laterally between the front cam track portion front cam groove 78B and the rear earn track portion rear cam groove 80B. In the preferred first embodiment of the closure 20B illustrated in FIGS. 31-57, the intermediate cam groove 84B joins the front cam groove 78B and rear cam groove 80B together in one single, continuous cam groove.

The intermediate cam groove 84B and the rear cam groove 80B are linear and are generally normal to the discharge direction of the contents through the access aperture 60B. In the preferred embodiment illustrated in FIG. 46, wherein the access aperture 60B is a cylindrical aperture defining a generally vertical axis parallel to the height of the closure 20B and to the height of the container (e.g., container 22 in FIG. 31), the linear intermediate cam groove 84B and the linear rear cam groove 80B are co-linear and are each generally normal to the axis of the access aperture 60B.

The bottom of the boat-shaped sidewall 50B of the closure body 26B is open, and when the closure 20B is installed on a container, the closure body bottom opening communicates with the container interior. The large opening across the bottom of the closure body 26B readily accommodates the flow of product from the container into the closure body 26B for discharge through the access aperture 60B when the closure 20B is in the open condition. This configuration provides the user of the package with the capability for discharging substantially all of the product out of the package, and this configuration can provide positive feedback to the user.

Figure 45:
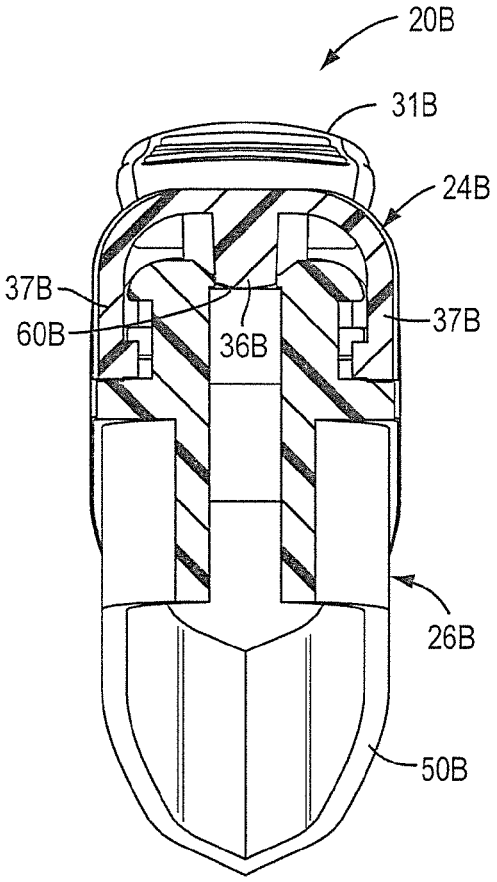
FIG. 45 is an enlarged, cross-sectional view taken generally along the plane 45-45 in FIG. 43.

When the manufacturer completes the manufacture of the closure body 26B and slider 24B (e.g., by molding each component from a suitable thermoplastic material), the manufacturer mounts the slider 24B on the closure body 26B. This is readily accommodated by a slight flexibility or resiliency of the slider sidewalls 37B and 39B which can temporarily and elastically deflect outwardly slightly and onto the closure body 26B as the slider 24B is pushed downwardly onto the top of the closure body 26B so that the slider front pins 40B and slider rear pins 42B move down to, and snap into, the cam track portion cam grooves. In particular, as can be seen in FIGS. 45 and 47, the slider front cam follower front pins 40B are received in the bottom end of the front cam track portion front cam grooves 78B when the slider 24B is properly installed in the fully closed position on the closure body 26B. Also, as can be seen in FIGS. 46 and 47, when the slider 24B is properly installed on the closure body 26B in the fully closed position, the slider rear cam follower rear pins 42B are received in the rear cam track portion rear cam grooves 80B.

The assembled closure components—the slider 24B and the closure body 26B—together constitute the closure 20B which can then be installed on a container that has already been filled with a product or that can subsequently be filled with a product, and thereafter the container which has been filled with the product and which has been closed with the closure 20B may be characterized as a "package" ready for use.

A user of the package who wishes to open the package may apply a force to the closure slider lever 31B (FIGS. 31, 33, and 46-57) in a direction that acts somewhat downwardly as well as rearwardly along the top of the closure 20B toward the handle 52B. As the user applies a downwardly and rearwardly acting force to the lever 31B, the lever 31B deflects downwardly, and the front of the pivotable portion 30B connected to the lever 31B is lifted upwardly as the forward portion of the pivotable portion 30B pivots upwardly at the elastically deformable pivot region 43B. With reference to FIG. 46, the upward pivoting or tilting of the front of the pivotable portion 30B lifts the sealing plug 36B out of the access aperture 60B. The front cam pins 40B are guided upwardly by the front cam grooves 78B as the plug 36B is moved upwardly with the pivotable portion 30B of the slider 24B. Then, as the closure slider 24B is moved rearwardly toward the handle 52B, the disengaged sealing plug 36B is carried with the slider 24B away from the access aperture 60B. The slider front cam pins 40B move rearwardly in the intermediate cam grooves 84B, and the slider rear cam pins 42B move rearwardly in the rear cam grooves 80B until the slider 24B is in the fully opened position on the closure body 26B (FIGS. 50-57).

The slider 24B, when operated with the lever 31B, works well in disengaging the plug 36B from the access aperture 60B. The slider 24B operates in a way that readily overcomes the friction between the slider 24B and closure body 26B. The lever 31B also beneficially provides a tactile sensation feedback to the user as the user pushes down on the lever 31B, When the slider 24B is in the fully opened position, the friction existing between the surfaces of the slider 24B and closure body 26B is sufficient to hold the slider 24B in the fully opened position during normal handling of the opened package by the user.

After the user has discharged, or otherwise removed, the desired amount of contents from the container through the opened closure 20B, the user can push the slider 24B forwardly to the fully closed position (FIGS. 31, 46, and 47) wherein the plug 36B is once again seated in the access aperture 60B to sealingly engage closure body 26B around the access aperture 60B.

It will also be appreciated that the upper surfaces of the third embodiment of the closure 20B illustrated in FIGS. 31-57 may be modified so as to present a surface, or a number of separated surfaces, that lie in a flat plane along the top of the closure so as to permit the closure to be turned upside down and placed on a counter or table in a vertical, but upside down, orientation.

It will also be appreciated that the closure 20B accommodates a relatively thin design that is especially suitable for use with thin packages such as flexible pouches or such as thin, rigid wall containers. A relatively thin closure and container can be used to create a relatively thin package which a user may find convenient for carrying in a pocket or purse.

The closure of the present invention, as can be seen from the illustrated embodiments thereof, permits a user to open the closure with an easy-to-execute sliding gesture. Similarly, the gesture required by a user to re-close the closure is readily effected.

Owing to the vertical movement of the slider seal (e.g., sealing plug 36, 36B), an effective occlusion and seal of the access aperture (e.g., access aperture 60 60B) is effected when the slider (slider 24, 24A, 24B) is in the fully closed position.

The closure of the present invention is especially suitable for, and very effective with, a pouch or container having a slender or thin configuration.

It will be readily observed from the foregoing detailed description of the invention and from the illustrations thereof that numerous other variations and modifications may be effected without departing from the true spirit and scope of the novel concepts or principles of this invention.

What is claimed is:

1. A closure (20, 20A, 20B) for a container (22, 22', 22A) that has an opening to the container interior wherein contents may be stored, said closure (20, 20A, 20B) comprising:

a body (26, 26A, 26B) that is either (a) a separate structure for being attached to said container (20, 22', 22A) at said opening, or (b) a structure formed as a unitary portion of said container (20, 22', 22A) at said opening, said body (26, 26A, 26B) having at least one access aperture (60, 60B) that can communicate with said container opening and that can accommodate removal of the contents in a discharge direction out of said at least one access aperture (60, 60B);

a sliding seal member (24, 24A, 24B) disposed on said body (26, 26A, 26B) for accommodating movement of said seal member (24, 24A, 24B) relative to said at least one access aperture (60, 60B) between (a) a closed position sealing against said closure body (26, 26A, 26B) at said at least one access aperture (60, 60B) to occlude said at least one access aperture (60, 60B), and (b) an open position exposing said at least one access aperture (60, 60B); and cooperating guide surfaces (40, 40B, 42, 42B, 78, 78B, 80, 80B, 84, 84B) on said body (26, 26A, 26B) and said sliding seal member (24, 24A, 24B) for guiding at least part of said sliding seal member (24, 24A, 24B) at least in said discharge direction away from said at least one access aperture (60, 60B) and for guiding said sliding seal member (24, 24A, 24B) at least in a lateral direction away from said at least one access aperture (60, 60B) to said open position, said cooperating guide surfaces (40, 40B, 42, 42B, 78, 78B, 80, 80B, 84, 84B) include (I) surfaces on one of said sliding seal member (24, 24A, 24B) and said closure body (26, 26A, 26B) defining (a) at least one front cam track portion (78, 78B) extending in said discharge direction, (b) at least one rear cam track portion (80, 80B), and (c) at least one intermediate cam track portion (84, 84B) that (i) is located laterally between said at least one front cam track portion (78, 78B) and said at least one rear cam track portion (80, 80B), and (ii) extends laterally at least from said at least one front cam track portion (78, 78B); and (II) surfaces on the other of said sliding seal member (24, 24A, 24B) and said closure body (26, 26A, 26B) defining (a) at least one front cam follower (40, 40B) for following said at least one front cam track portion (78, 78B) and said at least one intermediate cam track portion (84, 84B), and (b) at least one rear cam follower (42, 42B) for following said at least one rear cam track portion (80, 80B).

2. The closure (20, 20A, 20B) in accordance with claim 1 in which said closure (20, 20A, 20B) further includes a handle (52, 52A, 52B) extending rearwardly from said closure body (26, 26A, 26B).

3. The closure (20, 20A, 20B) in accordance with claim 1 in which said sliding seal member (24, 24A, 24B) includes at least two sidewalls (32, 37B, 39B); and said cooperating guide surfaces (40, 40B, 42, 42B, 78, 78B, 80, 80B, 84, 84B) include a rear pin (42, 42B) and a front pin (40, 40B) projecting from each of said sliding seal member sidewalls (32, 37B, 39B).

4. The closure (20, 20A, 20B) in accordance with claim 1 in which said sliding seal member (24, 24A, 24B) includes a projecting plug (36, 36B) having a distal end for sealingly engaging said closure body (26, 26A, 26B) at said at least one access aperture (60, 60B) so as to occlude said at least one access aperture (60, 60B) when said sliding seal member (24, 24A, 24B) is in said closed position.

5. The closure (20, 20A) in accordance with claim 4 in which said closure body (26, 26A) defines a recess (68) spaced from said at least one access aperture (60) for receiving said distal end of said plug (36) as said sliding seal member (24, 24A) moves laterally toward said open position.

6. The closure (20A, 20B) in accordance with claim 1 in which said at least one rear cam track portion (80, 80B) is a rear cam groove (80, 80B) in said closure body (26, 26A, 26B);

said at least one intermediate cam track portion (84, 84B) is an intermediate cam groove (84, 84B) in said closure body (26, 26A, 26B);

said at least one front cam track portion (78, 78B) is a front cam groove (78, 78B) in said closure body (26, 26A, 26B);

said at least one front cam follower (40, 40B) is a front pin (40, 40B) that is located on said sliding seal member (24, 24A, 24B) and that is receivable sequentially in said front cam groove (78, 78B) and in said intermediate cam groove (84, 84B); and said at least one rear cam follower (42, 42B) is a rear pin (42, 42B) that is located on said sliding seal member (24, 24A, 24B) and that is receivable in said rear cam groove (80, 80B).

7. The closure (20B) in accordance with claim 6 in which said rear cam groove (80B), said intermediate cam groove (84B), and said front cam groove (78B) together define a single continuous groove (78B, 84B, 80B).

8. The closure (20) in accordance with claim 6 in which said front cam groove (78) and said intermediate cam groove (84) together define a first cam groove (78, 84); and said rear cam groove (80) defines a second cam groove (80) that is separate from said first cam groove (78, 84).

9. The closure (20) in accordance with claim 8 in which said rear cam groove (80) is linear and is generally normal to said discharge direction; and said intermediate cam groove (84) is linear and is oriented to slope away from said access aperture (60) with increasing distance rearwardly from said access aperture (60).

10. A closure (20, 20A, 20B) for a container (22, 22', 22A) that has an opening to the container interior wherein contents may be stored, said closure (20, 20A, 20B) comprising:

a body (26, 26A, 26B) that is either (a) a separate structure for being attached to said container (20, 22', 22A) at said opening, or (b) a structure formed as a unitary portion of said container (20, 22', 22A) at said opening, said body (26, 26A, 26B) having at least one access aperture (60, 60B) that can communicate with said container opening and that can accommodate removal of the contents in a discharge direction out of said at least one access aperture (60, 60B);

a sliding seal member (24, 24A, 24B) disposed on said body (26, 26A, 26B) for accommodating movement of said seal member (24, 24A, 24B) relative to said at least one access aperture (60, 60B) between (a) a closed position sealing against said closure body (26, 26A, 26B) at said at least one access aperture (60, 60B) to occlude said at least one access aperture (60, 60B), and (b) an open position exposing said at least one access aperture (60, 60B); and cooperating guide surfaces (40, 40B, 42, 42B, 78, 78B, 80, 80B, 84, 84B) on said body (26, 26A, 26B) and said sliding seal member (24, 24A, 24B) for guiding at least part of said sliding seal member (24, 24A, 24B) at least in said discharge direction away from said at least one access aperture (60, 60B) and for guiding said sliding seal member (24, 24A, 24B) at least in a lateral direction away from said at least one access aperture (60, 60B) to said open position, wherein (a) said sliding seal member (24B) defines (i) a base portion (35B); and (ii) pivotable portion (30B);

(b) said pivotable portion (30B) includes (i) a projecting seal (36B) for sealingly engaging said body at said at least one access aperture (60B) so as to occlude said at least one access aperture (60B) when said sliding seal member (24B) is in said closed position;

(ii) an elastically deformable pivot region (43B) located between said seal (36B) and said base portion (39B); and (iii) a rearwardly extending lever (31B) which extends over said base portion (35B) and which can be forced toward said base portion (35B) by a user so as to pivot said pivotable portion (30B) to disengage said projecting seal (36B) from said closure body (26B).

11. The closure (20B) in accordance with claim 10 in which said projecting seal (36B) is a projecting cylindrical plug (36B) having an arcuate distal end edge (38B) for engaging said closure body (26B) at said at least one access aperture (60B).

12. The closure (20B) in accordance with claim 10 in which said closure body (26B) defines a chamfered surface (64B) around said at least one access aperture (60B).

13. The closure (20B) in accordance with claim 10 in which said pivotable portion (30B) and base portion (35B) of said sliding seal member (24B) each have a sidewall (37B, 39B) that defines between them a notch (41B) terminating at said elastically deformable pivot region (43B).

* * * * *